US006125596A

United States Patent [19]

Goto

[11] Patent Number: 6,125,596

[45] Date of Patent: Oct. 3, 2000

[54] JOINT COVER DEVICE

[75] Inventor: Hideo Goto, Kuwana, Japan

[73] Assignee: Doei Gaiso Yugen Gaisha, Mie-ken, Japan

[21] Appl. No.: 09/128,501

[22] Filed: Aug. 3, 1998

[30] Foreign Application Priority Data

Aug. 14, 1997 [JP] Japan ..... 9-235456

[51] Int. Cl.[7] ..... E04B 1/98

[52] U.S. Cl. ..... 52/167.4; 52/396.04

[58] Field of Search ..... 52/167.4, 396.04

[56] References Cited

U.S. PATENT DOCUMENTS 5,887,308 3/1999 Walter ..... 52/396.04

FOREIGN PATENT DOCUMENTS 551974 3/1993 Japan ..... 52/167.4

*Primary Examiner*—Christopher T. Kent
*Assistant Examiner*—Dennis L. Dorsey
*Attorney, Agent, or Firm*—Jordan and Hamburg LLP

[57] ABSTRACT

A joint cover device includes a joint cover which covers a joint part of right and left building members. The joint cover has ends supported on surfaces adjacent the joint part. A retaining device is provided for retaining the joint cover in a central position. The retaining device has ends attached to the right and left building members. The retaining devices further include a first bar member that engages a gear and has one end rotatably a side portion of one of the building members in a horizontal direction. A second bar member engages the gear and has one end rotatably attached to a side portion of the other building member in a horizontal direction. The first bar member faces the second bar member in an inclined orientation relative to the building members. The gear engages the first bar member and the second bar member. A support member is pivotably attached to a pivot pin at a central portion of the joint cover and supports rotatably the gear and slidably supports the first and second bar members so that the joint cover device can absorb vibration and swing movement because of rotation of the bar member in a horizontal direction and geared engagement of the bar members when the right and left buildings are oscillated relative one another.

11 Claims, 33 Drawing Sheets

JOINT COVER DEVICE

BACKGROUND OF THE INVENTION

The present invention relates generally to a joint cover device for concealing a variable joint part of a floor surface, a wall surface, a ceiling surface or the like of right and left building members defining the joint part.

The conventional joint cover device includes a central retaining device having a square-link shape mechanism to retain always a joint cover covering the joint at a central portion of the joint part. The central retaining device can absorb vibration and swing movement due to an earthquake, or the like. However, in the case of buildings with a structure having the latest earthquake-resistant structures the range for absorbing vibration or swing movement is large and the vibration or swing movement is a circular movement which breaks the conventional central retaining device.

SUMMARY OF THE INVENTION

Accordingly, it is an object of the present invention to provide a joint cover device which can absorb a large vibration, swing or oscillation movements, by circular movement.

The novel features which are believed to be characteristic of the invention, both as to its organization and method of operation, together with further objects and advantages thereof will become apparent from the following description read in conjunction with the accompanying drawings in which a presently preferred embodiment of the invention is illustrated by way of examples.

It is to be expressly understand, however, that the drawings are for the purpose of illustration and description only, and are not intended as a definition of the limits of the invention.

DESCRIPTION OF THE PREFERRED EMBODIMENT

Figure 1:
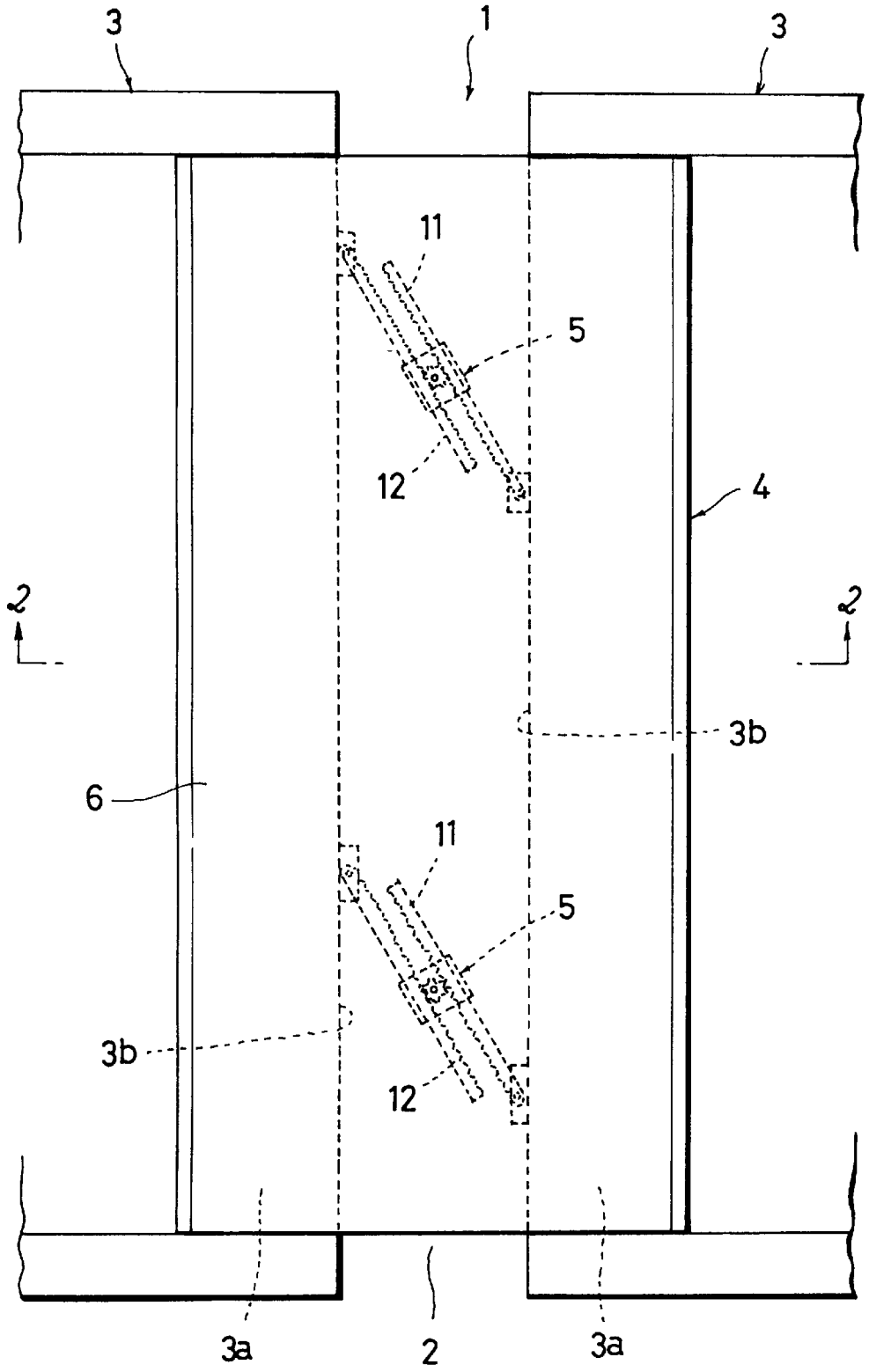
FIG. 1 is a plan view showing a first embodiment of the present invention.
Figure 2:
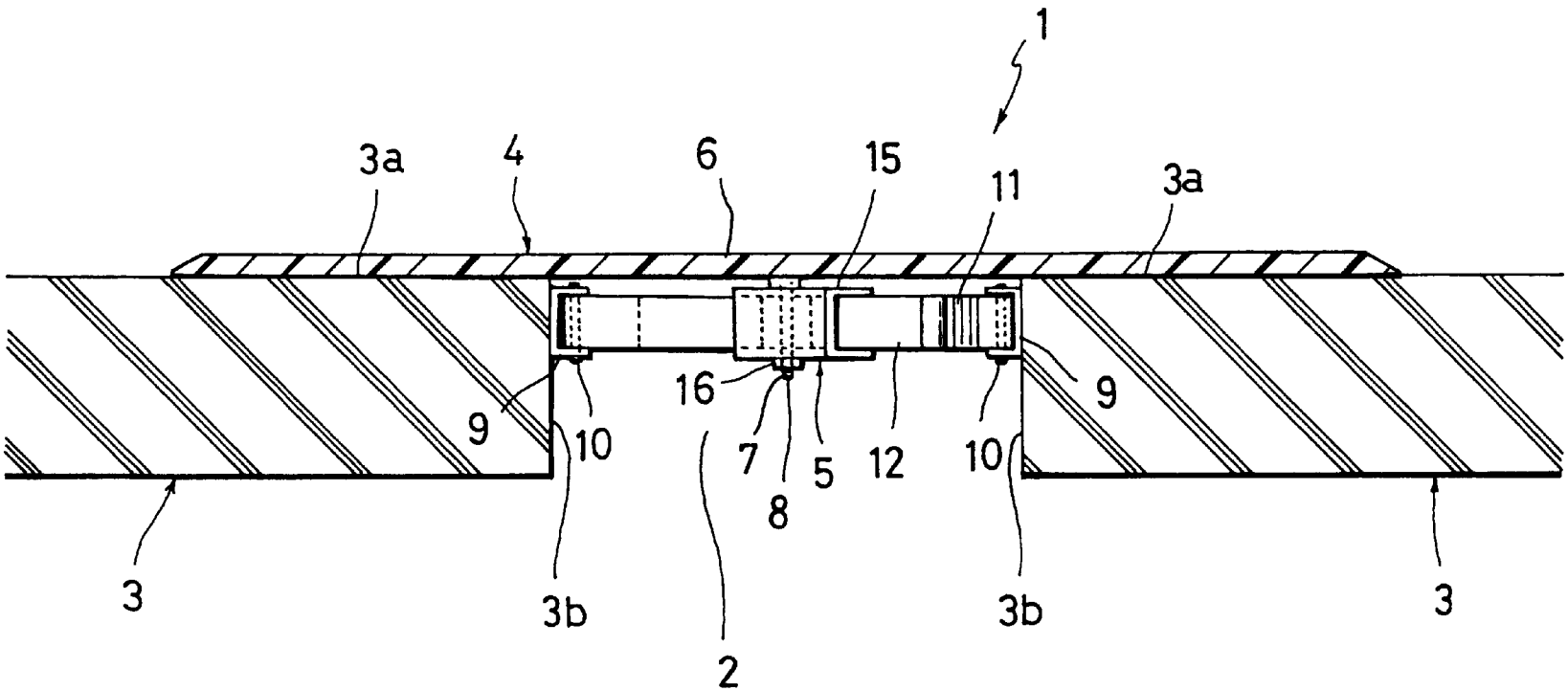
FIG. 2 is an expanded cross-sectional view taken along the line 2—2 of FIG. 1.
Figure 3:
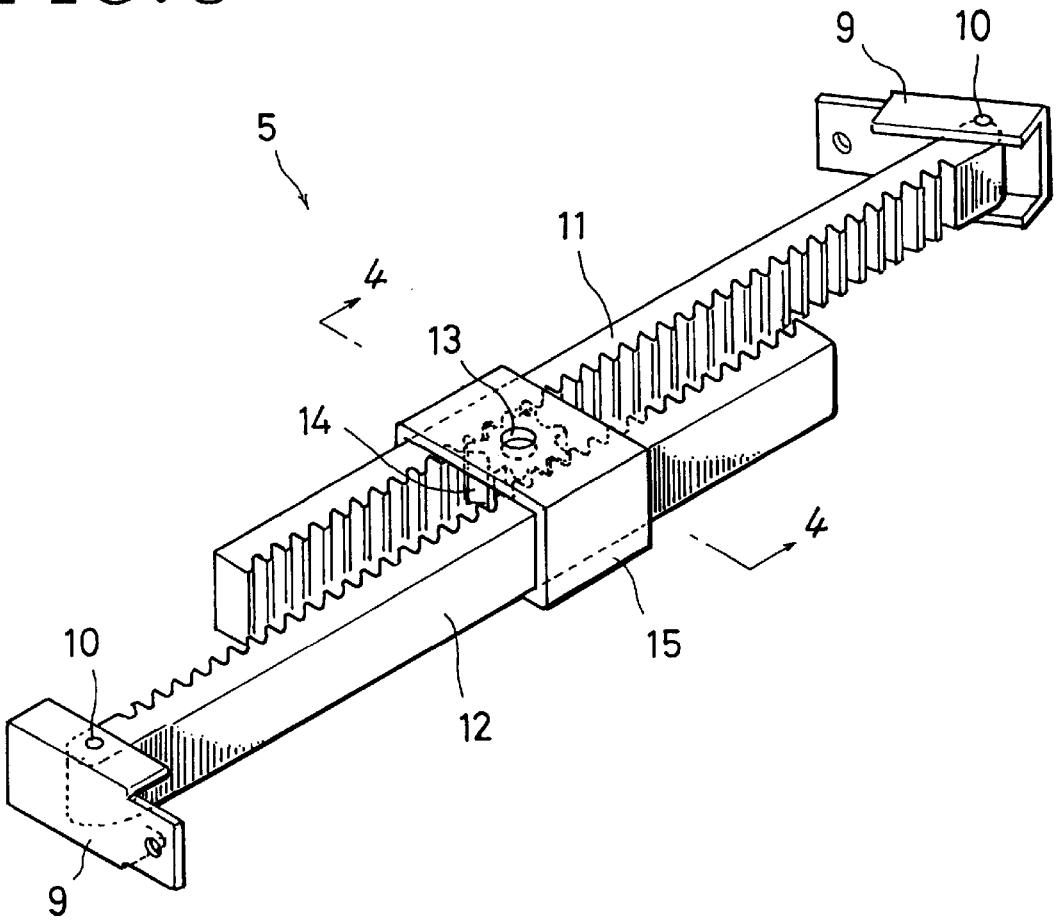
FIG. 3 is a perspective view of a device for retaining a joint cover at a central position.
Figure 4:
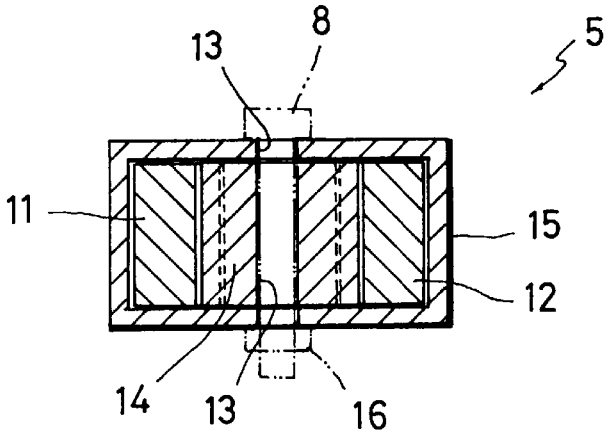
FIG. 4 is a cross-sectional view taken along the line 4—4 of FIG. 3.
Figure 5:
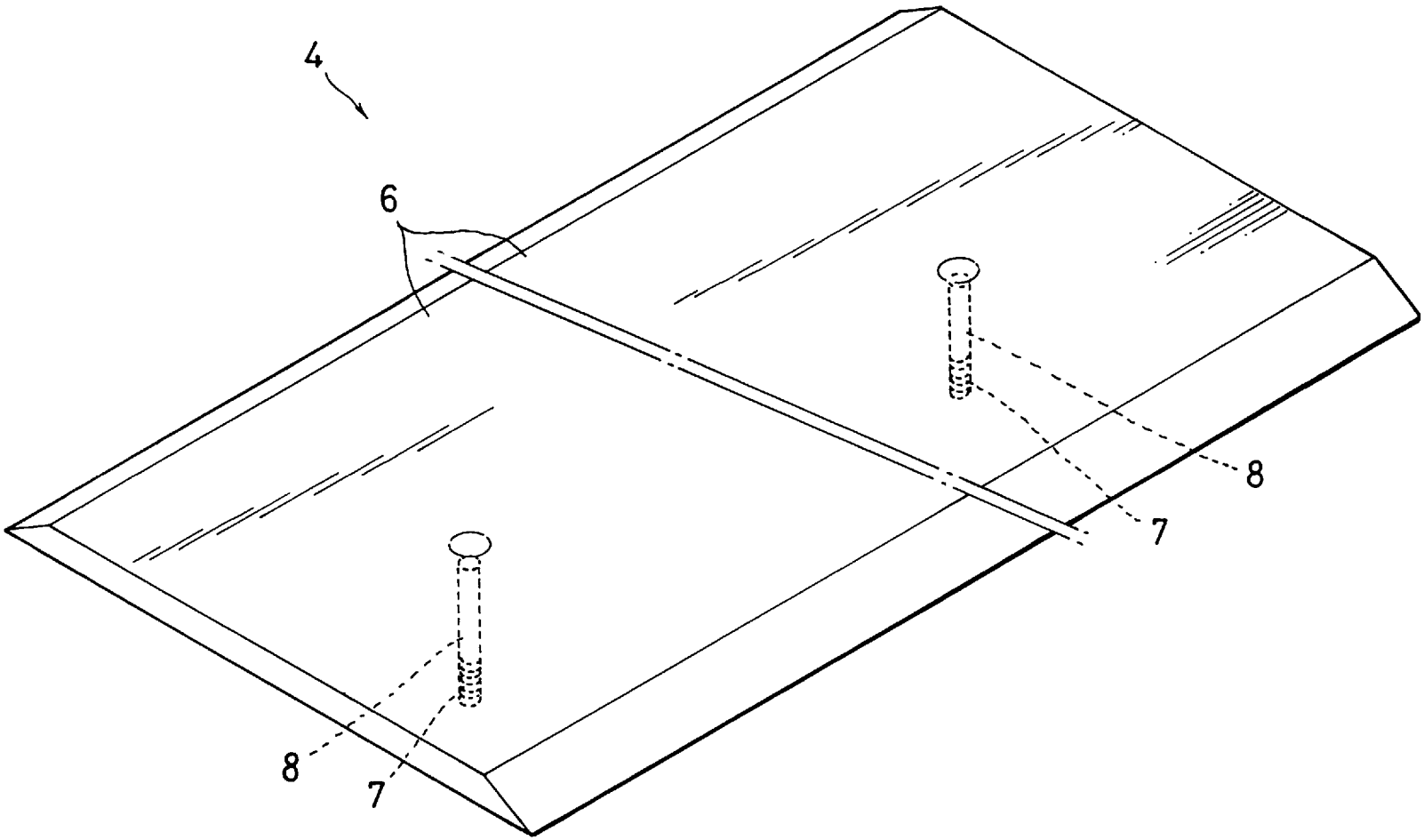
FIG. 5 is a perspective view of a joint cover.
Figure 6:
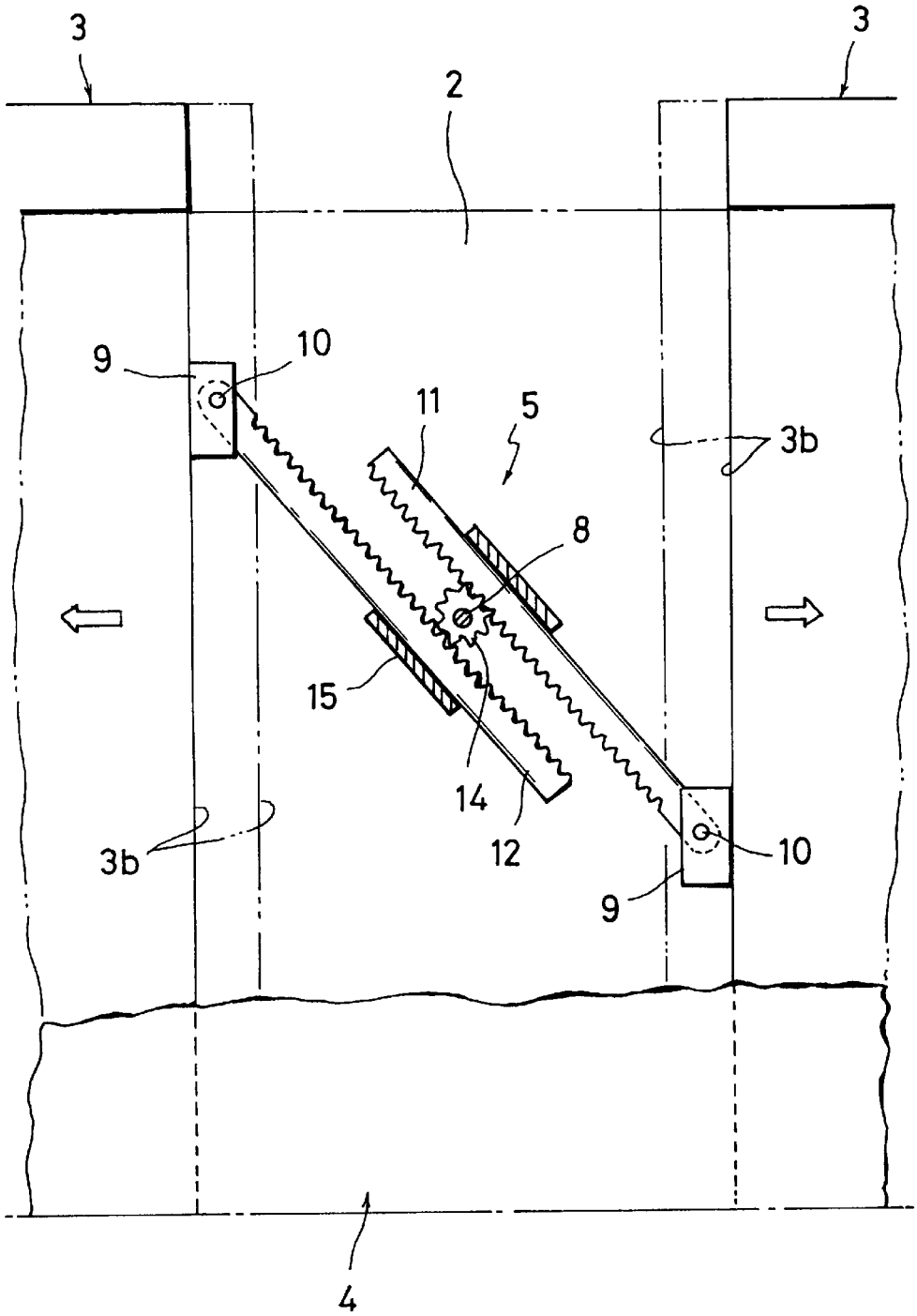
FIG. 6 is a cut-away plan view showing expansion of a joint part.
Figure 7:
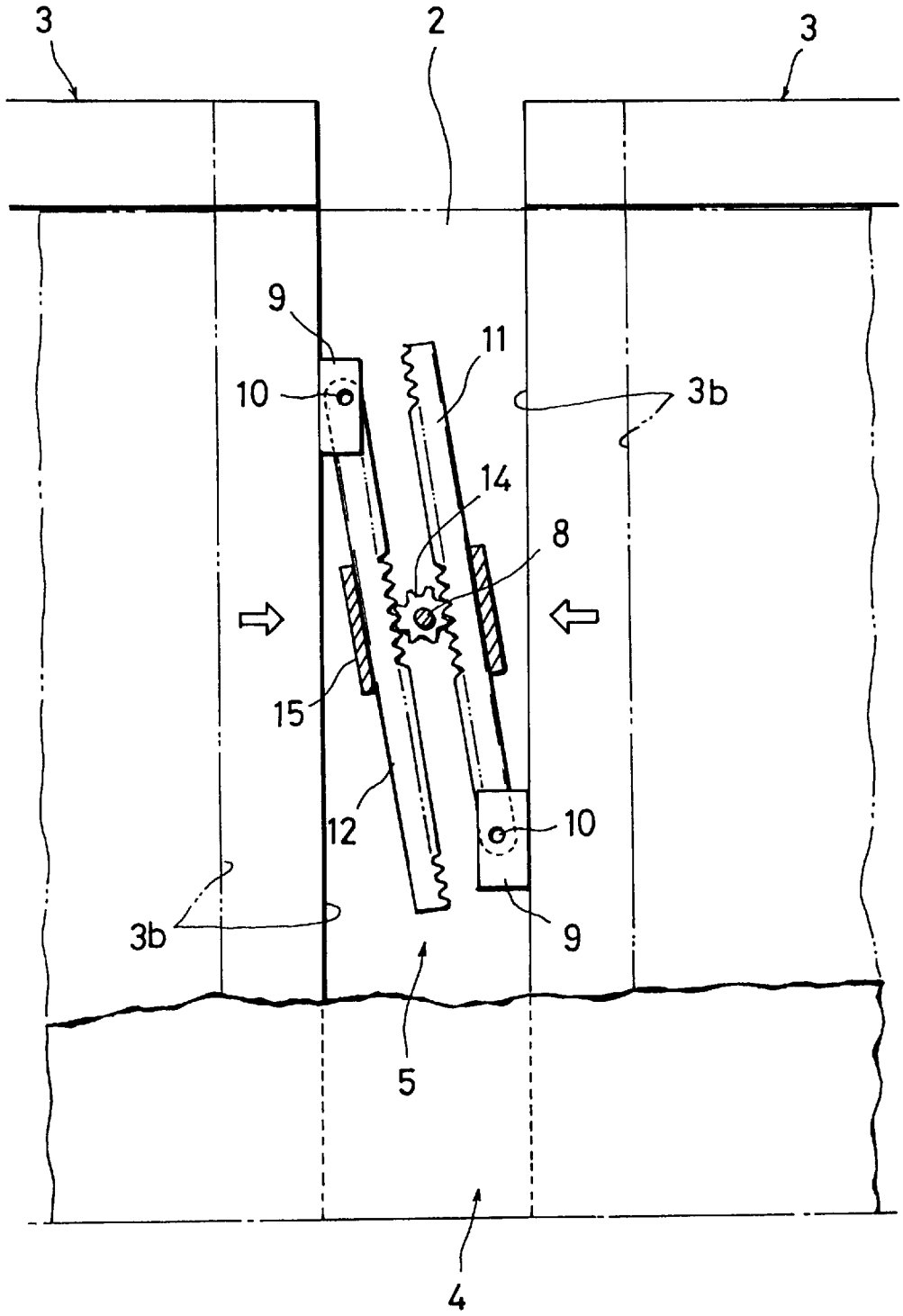
FIG. 7 is a cut-away plan view showing contraction of a joint part.
Figure 8:
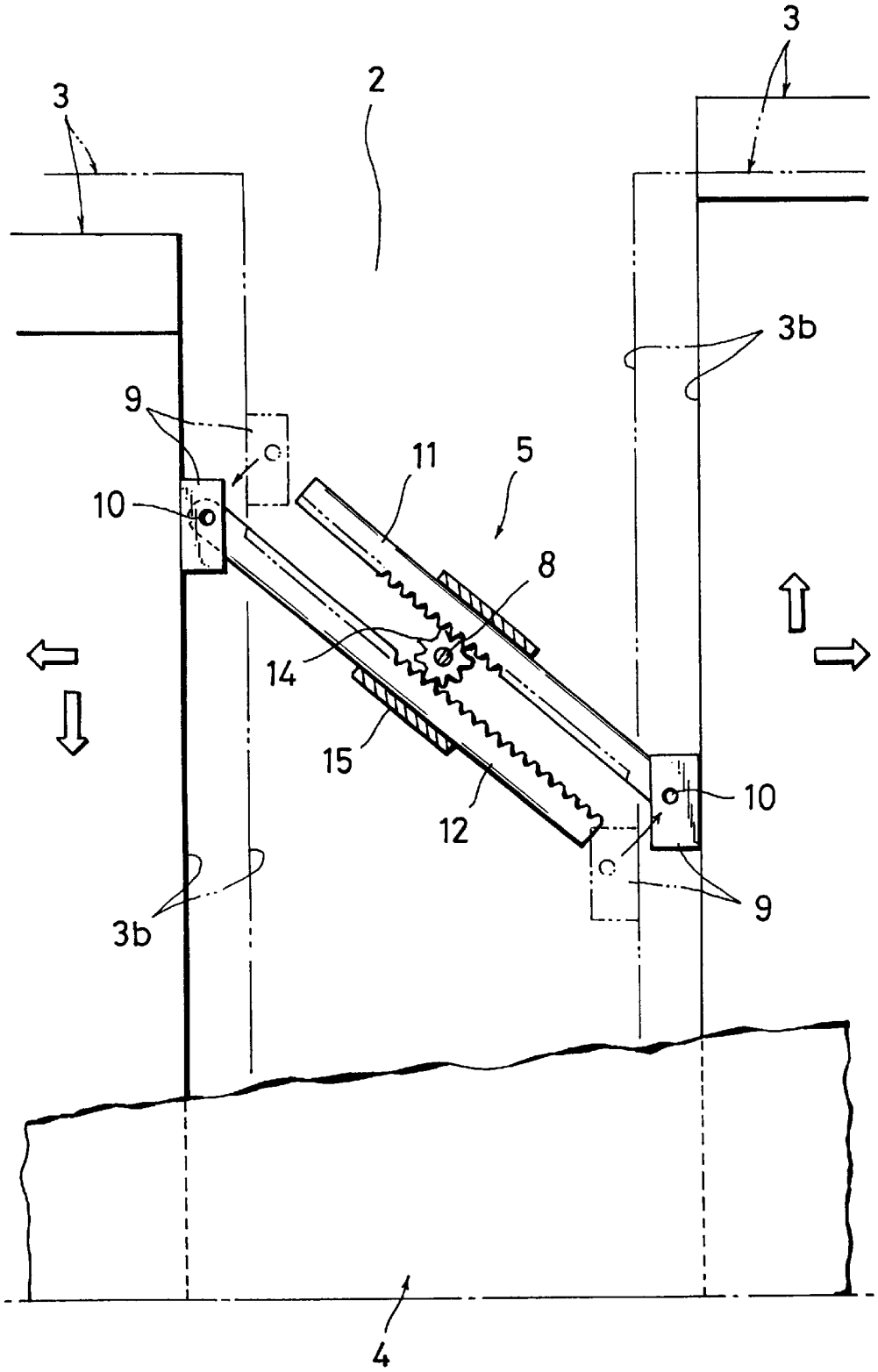
FIG. 8 is a cut-away plan view showing a joint part expanding and building members swinging in different back-and-forth directions.
Figure 9:
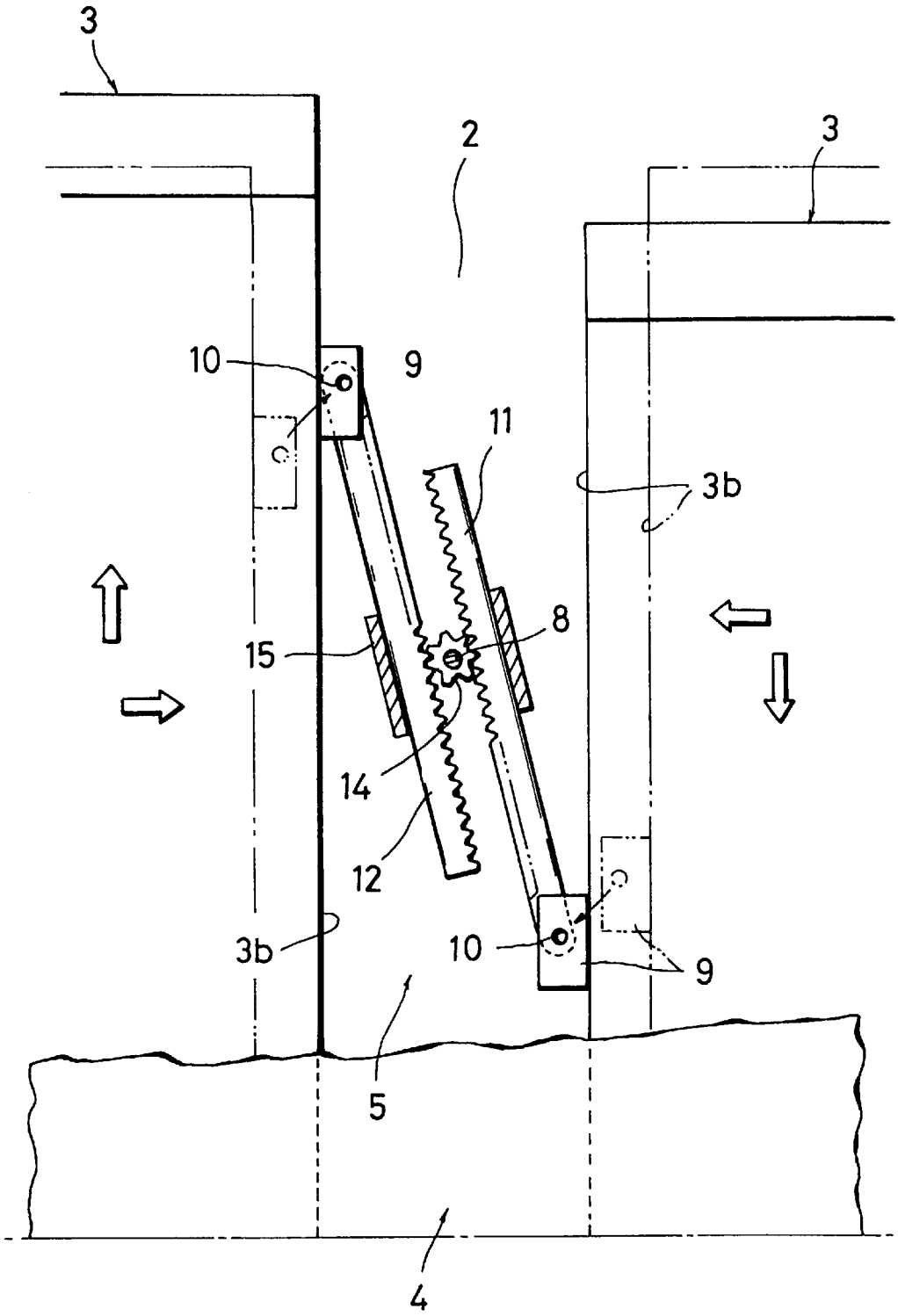
FIG. 9 is a cut-away plan view showing a joint part contracting and building members swinging in different back-and-forth directions.

Preferred embodiments of the present invention will be described in more detail below, referring to the accompanying drawings.

An understanding of the present invention may be best gained by reference to FIGS. 1 to 9. FIGS. 1 to 9 illustrate a joint cover device of a first embodiment of the present invention. The joint cover device 1 covers a joint part 2 of floor surfaces of right and left building members 3,3 defining the joint part 2 and comprises a joint cover 4-supported by floor surfaces 3*a*, 3*a*. Wall surfaces are located adjacent to the joint part 2 on both ends thereof. Devices 5, 5 for retaining the joint cover 4 at a central position of the joint part 2 are attached to right and left building portions 3*b*, 3*b*, at locations adjacent to both sides of the joint cover 4.

The joint cover 4 further comprises a joint cover body 6 in the form of a plate which is made of metallic material such as aluminium, alloy, stainless steel, stainless steel alloy, or the like. The joint cover has a sloping surface at upper portions of both sides thereof and pivot pins 8,8 fixed to a bottom surface adjacent both sides of the joint cover body 6, so as to project downward. Each of the pivot pins 8,8 has a thread part on a tip portion thereof.

The devices 5, 5 for retaining the joint cover at a central position further include first rack 11 as a bar member, second rack 12 as another bar member, and a pinion 14 as a gear having an axle hole 13, and a support member 15.

First rack 11 is fixed to a building portion 3*b* of the joint part 2 side of one building member 3 on one end thereof and and engages a gear which is pivotably attached to a fixing tool 9 by a pivot pin 10 in a horizontal direction.

Second rack 12 is fixed to the building portion 3*b* of the joint part side of one of building member 3 on one end thereof so as to face the first rack 11 in a fixed sloping angle, for example a 30 degree angle of inclination, and engages a gear which is pivotably attached to the fixing tool 9 by a pivot pin 10 in a horizontal direction.

The pinion 14 includes the axle hole 13 engaged by the pivot pin 8 so as to engage the first and second racks, 11 and 12, at a substantially central portion of the joint part 2.

The support member 15 having the axle hole 13 is slidably attached to the first and second racks, 11 and 12, and supports rotatably the pinion 14, the axle hole 13 passing through one axle hole 13 of the pinion 14.

In the above joint cover device 1, the devices 5,5 are attached to the building portions 3*b*, 3*b*, of the right and left building members 3,3.

The pinions 14,14 of the devices 5,5 and the axle holes 13,13 of the support members 15,15 are receive the pivot pins 8,8 of the joint cover 4 therein, and the joint part 2 is covered by the joint cover 4.

Nuts 16,16 are applied to the thread parts 7,7 of the pivot pins 8,8 which project downward below the lower part of the pinions 14,14, and thus the joint cover 4 is attached to the devices 5,5.

The above-mentioned joint cover device 1 can move as shown in FIGS. 6 to 9 and to absorb vibration or swing movement even if the right and left building members 3,3 move back-and-forth and/or in right-left directions producing a circular movement by an earthquake, or the like.

Other embodiments of the present invention will now be described referring to FIGS. 10 to 34. Throughout the drawings of the embodiments, like components are denoted by like numerals as of the first embodiment and will not therefore by explained in greater detail.

Figure 10:
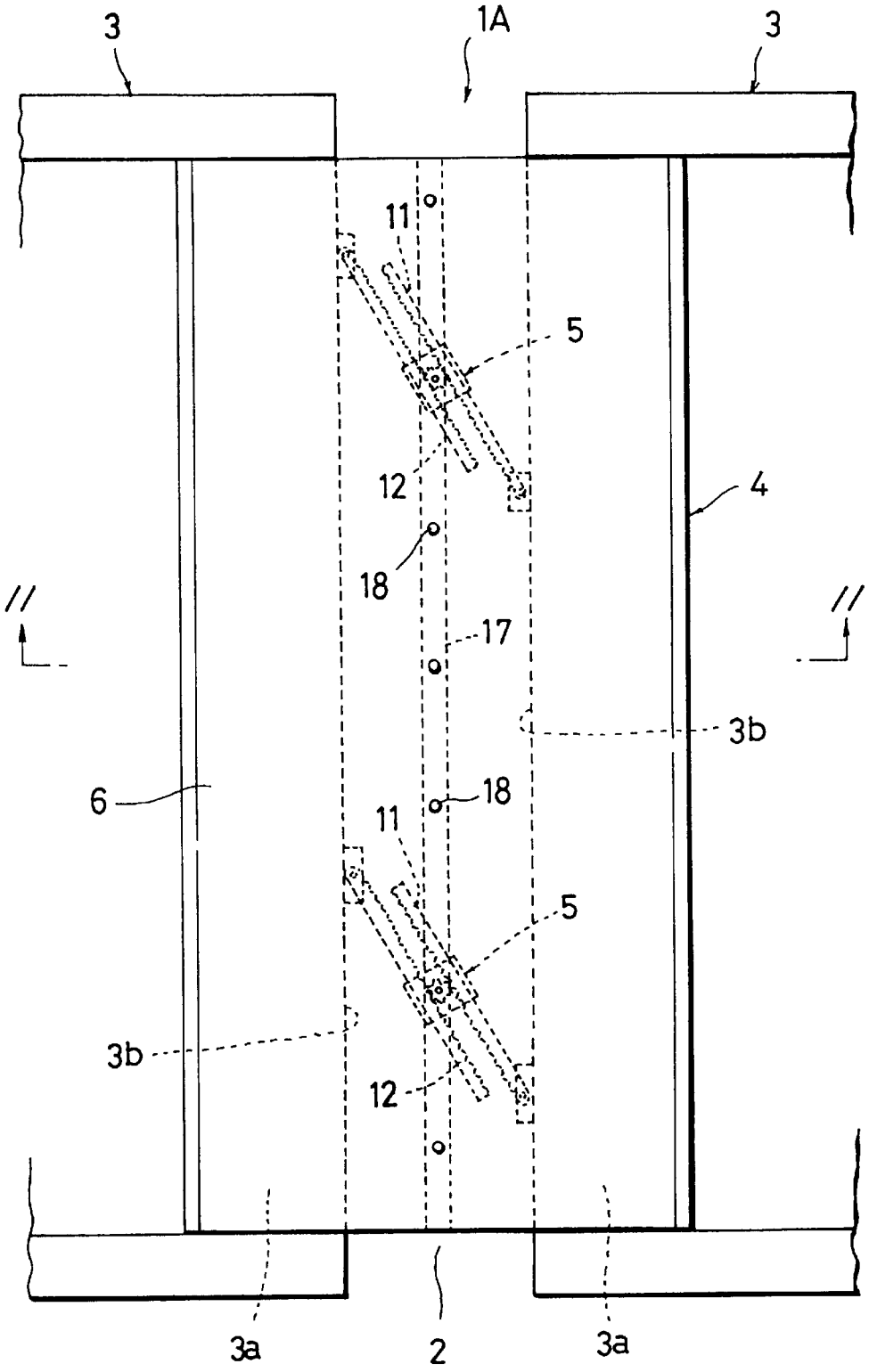
FIG. 10 is a plan view showing a second embodiment of the present invention.
Figure 11:
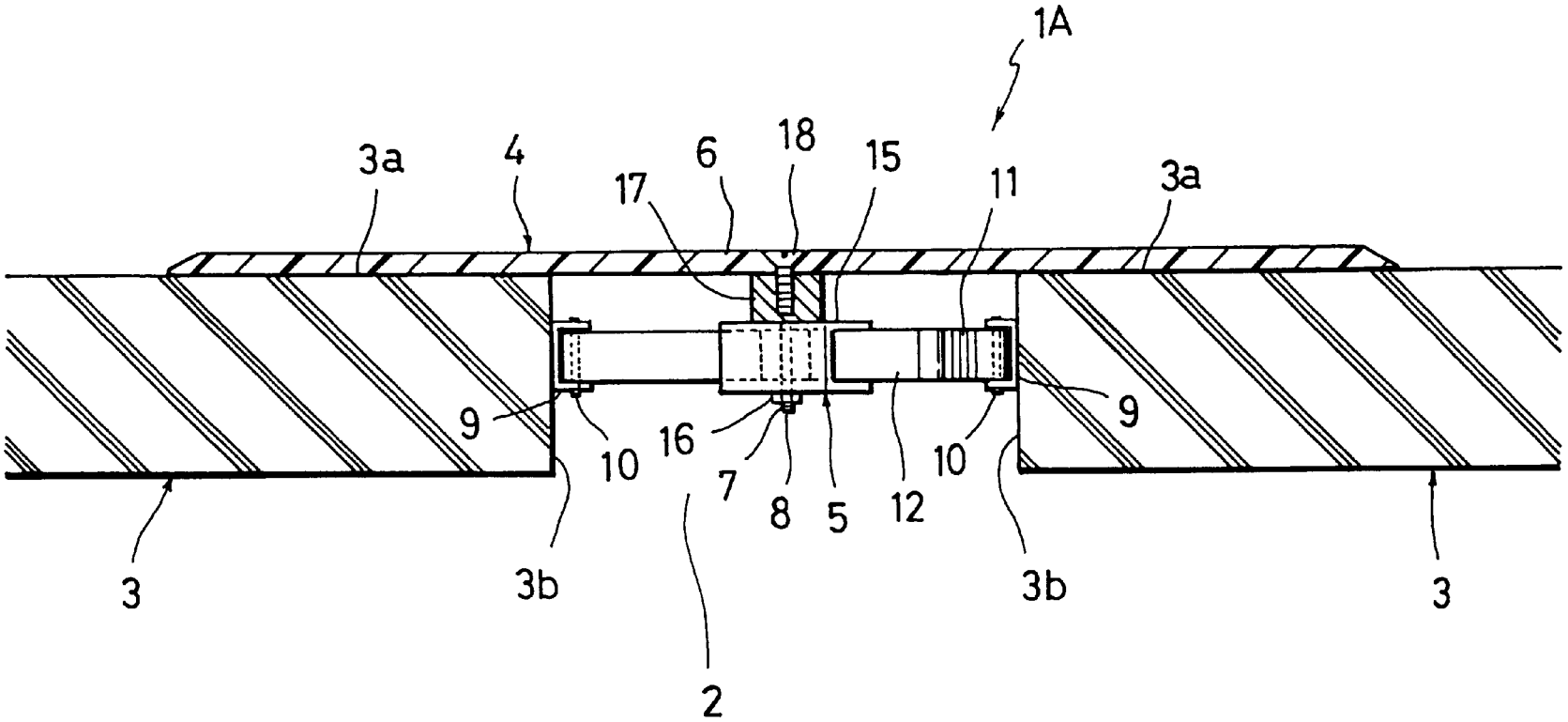
FIG. 11 is a cross-sectional view taken along the line 11—11 of FIG. 10.
Figure 12:
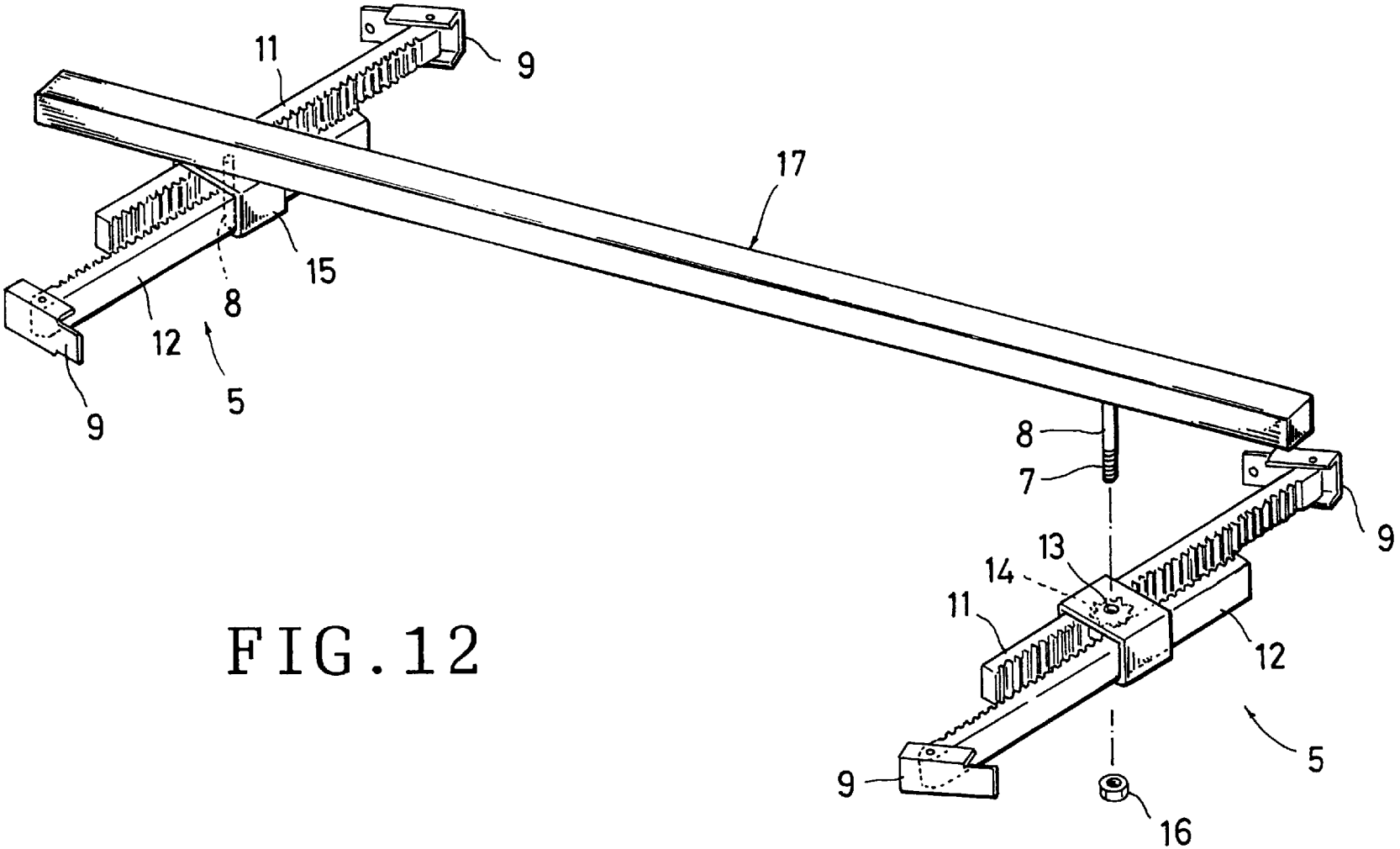
FIG. 12 is a perspective partially exploded view of a device for retaining joint cover at a central position.

FIGS. 10 to 12 illustrate a second embodiment of the present invention which is distinguished from the first embodiment by the fact that the joint cover 4 is attached to a joint cover support rod 17 by a plurality of flat head screw 18, the joint cover support rod 17 having pivot pins 8,8 which are inserted into the axle holes 13,13 of the support members 15,15 of the devices 5,5. A joint cover device 1A with the joint cover support rod 17 according to the second embodiment has similar advantages to that according to the first embodiment.

Figure 13:
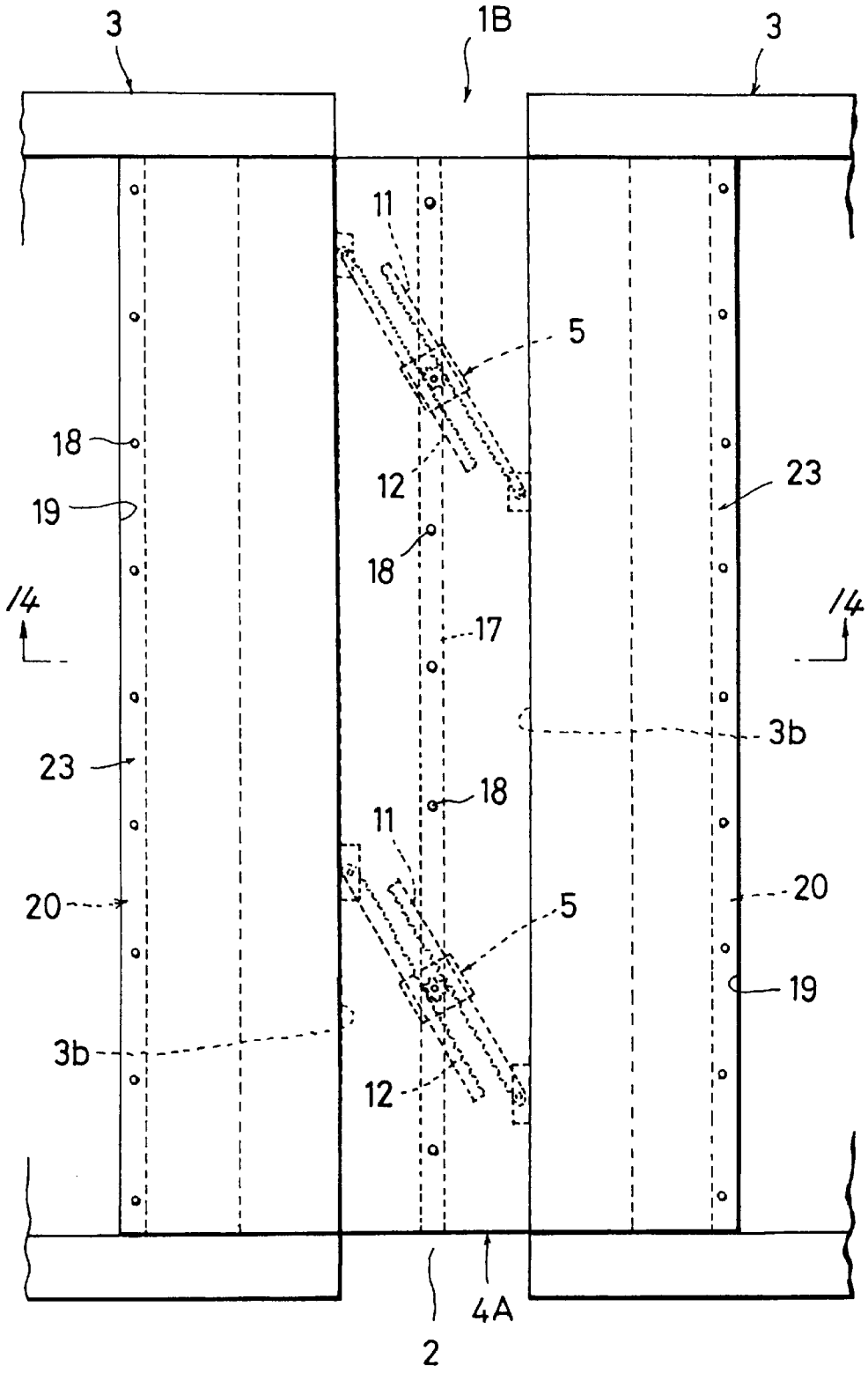
FIG. 13 is a plan view showing a third embodiment of the present invention.
Figure 14:
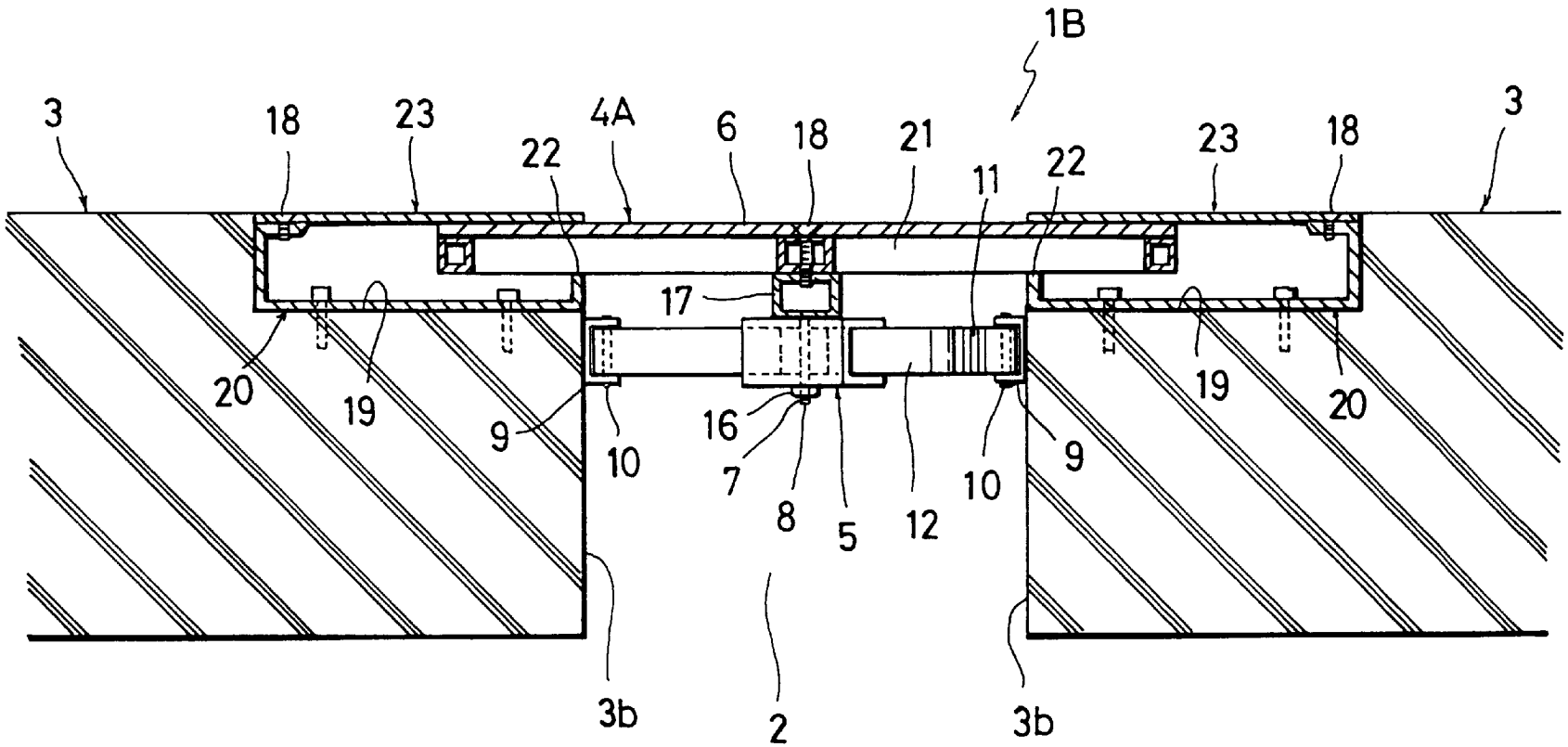
FIG. 14 is an expanded cross-sectional view taken the line 14—14 or FIG. 13.
Figure 15:
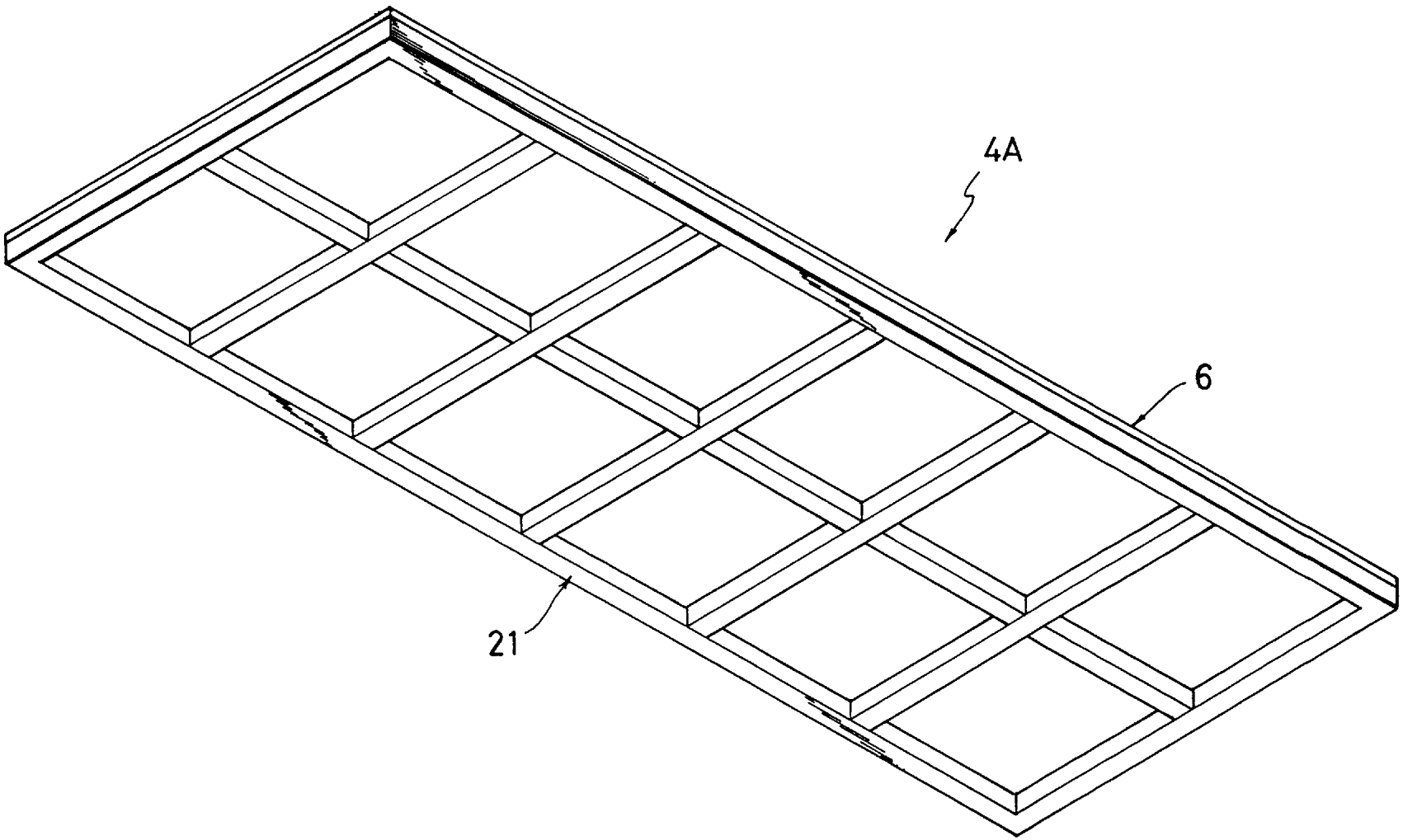
FIG. 15 is a perspective view of a joint cover.
Figure 16:
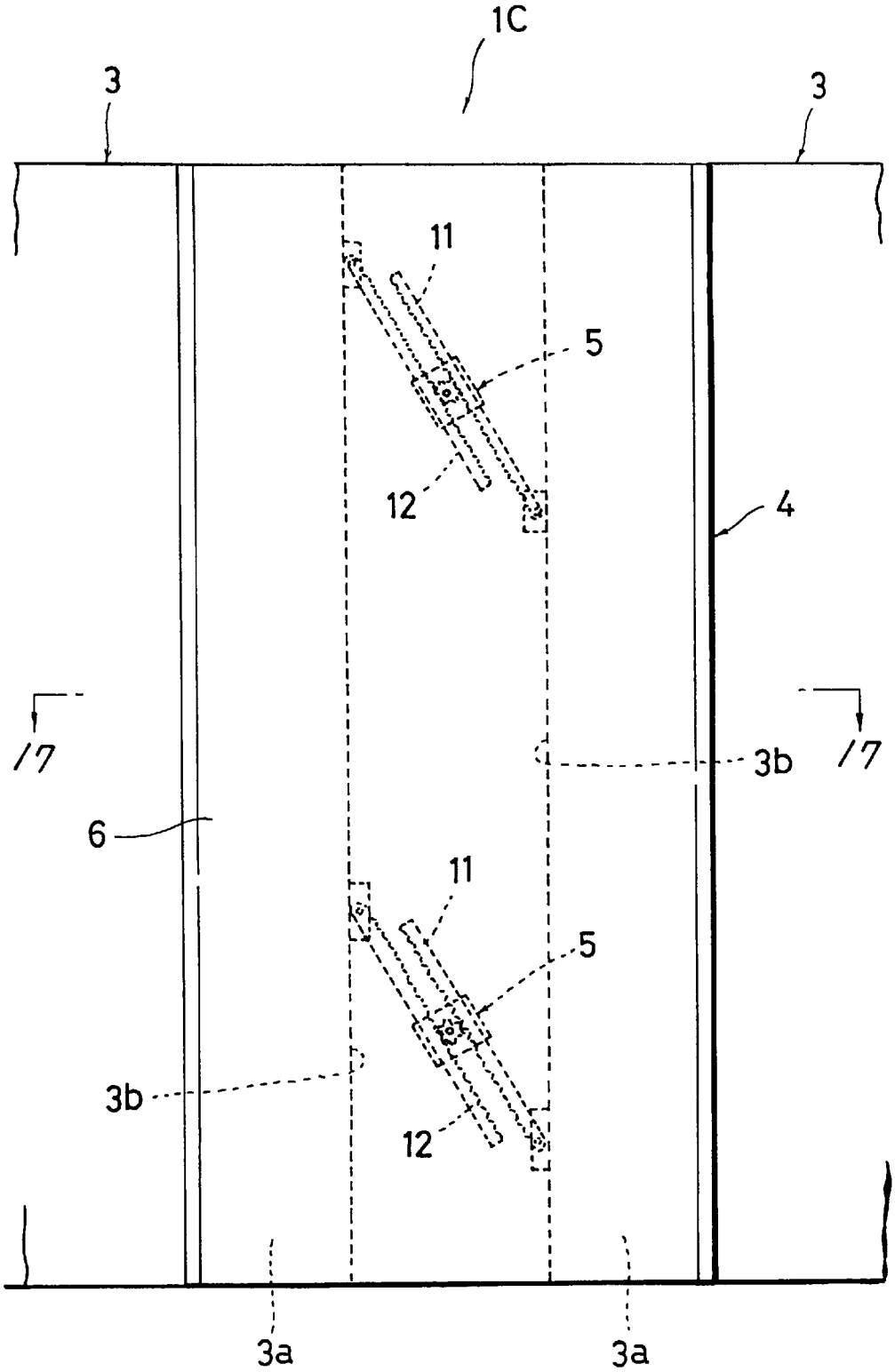
FIG. 16 is a front view showing a fourth embodiment of the present invention.
Figure 17:
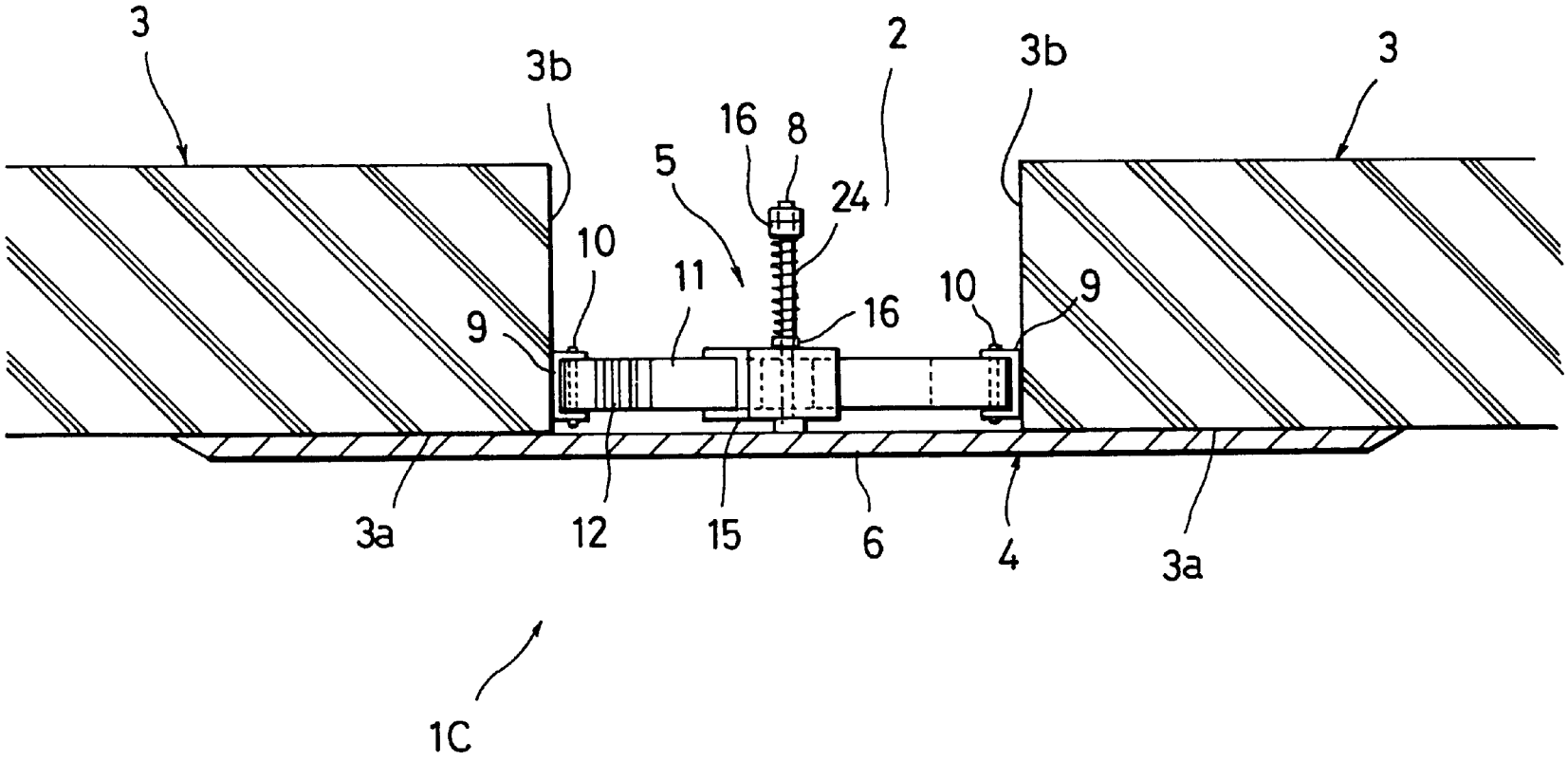
FIG. 17 is an expanded cross-sectional view taken along the line 17—17 of FIG. 16.
Figure 18:
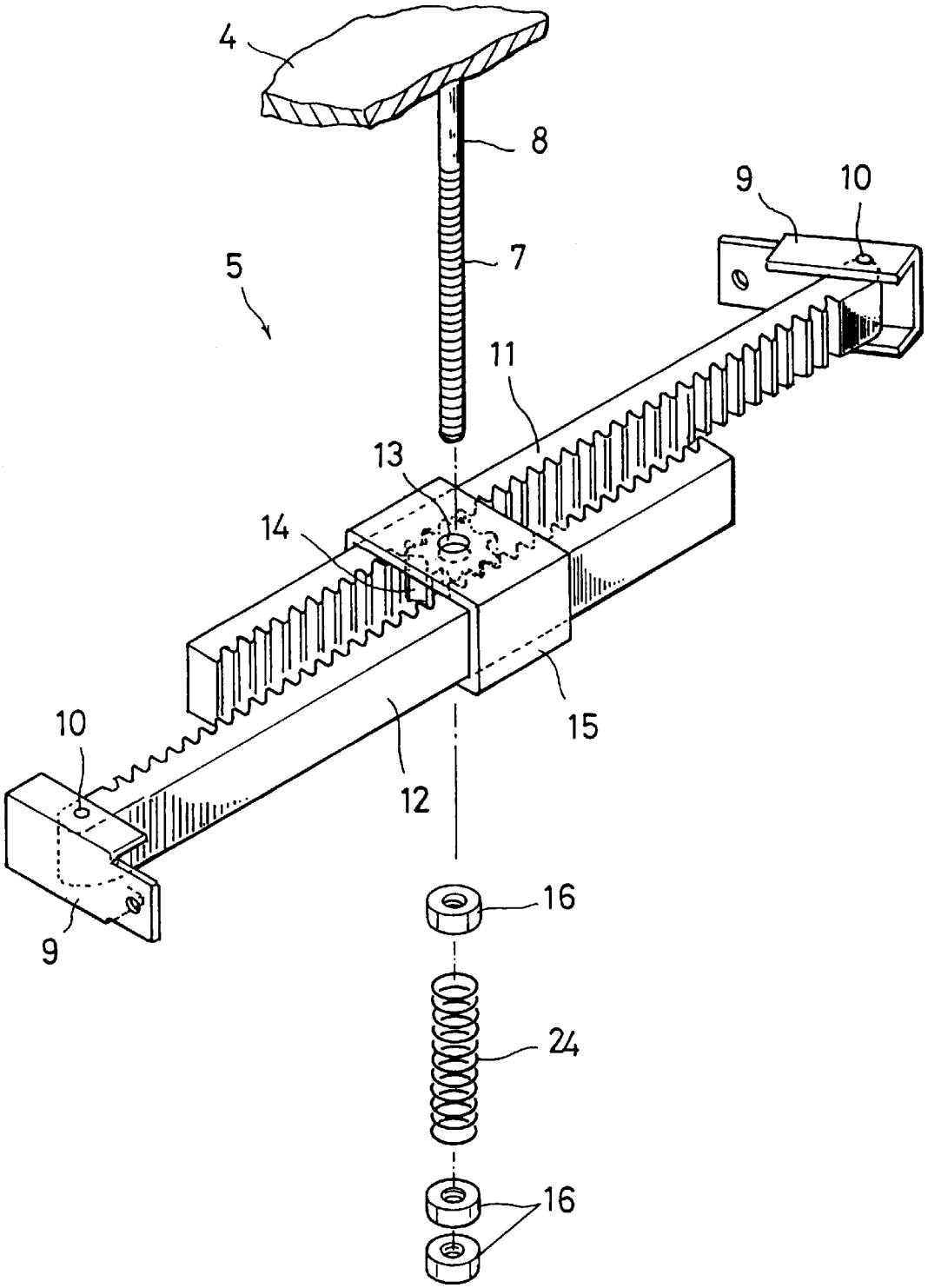
FIG. 18 is a perspective partially exploded view of a device for retaining joint cover at a central position.

FIGS. 13 to 15 illustrate a third embodiment of the present invention which is distinguished from the second embodiment by the fact that recessed portions 19,19 are formed in the floor surface adjacent the joint part 2, and substrate rails 20,20 are fixed into the recessed portions 19,19. Also the joint cover 4 is replaced with another like joint cover 4A, the joint cover 4A having a joint cover reinforcement body 21 which reinforces the joint cover body 6 on a bottom surface thereof. Joint part side support parts 22,22 of the substrate rails 20,20 support the joint cover 4A. In addition, cover plates 23,23 are disposed over both sides of the joint cover 4A and fixed to the substrate rails 20,20 by a plurality of flat head screws 18. A joint cover device 1B according to the third embodiment has similar advantages to that according to the second embodiment FIGS. 16 to 18 illustrate a fourth embodiment of the present invention which is distinguished from the first embodiment by the fact that the joint cover 4 covers a joint part 2 of a wall surface or a ceiling surface, and springs 24,24 are interposed between the support members 15,15 and the nuts 16,16 attached to the pivot pins 8,8. A joint cover device 1C according to the fourth embodiment has similar advantages to that according to the first embodiment.

Figure 19:
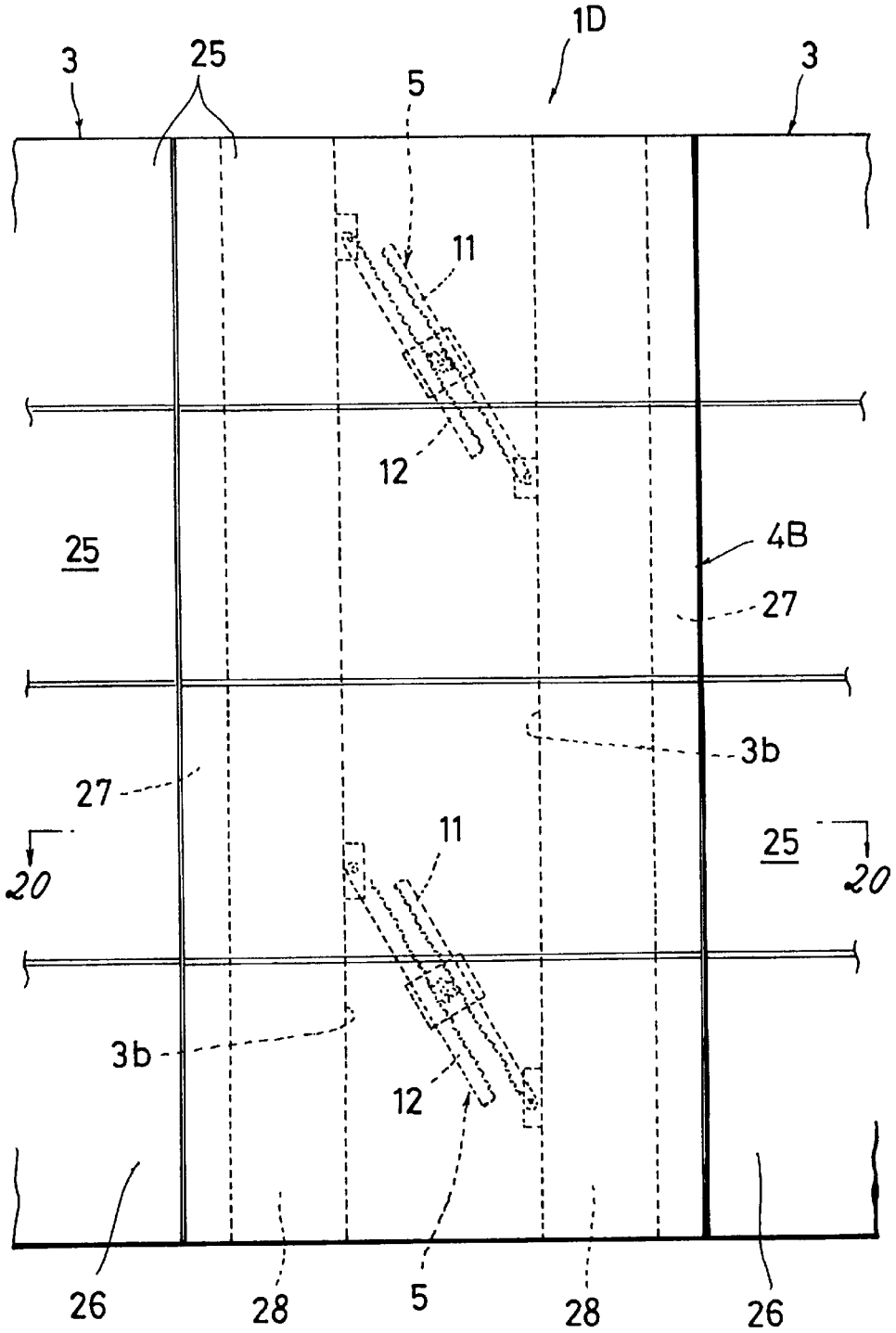
FIG. 19 is a front view showing a fifth embodiment of the present invention.
Figure 20:
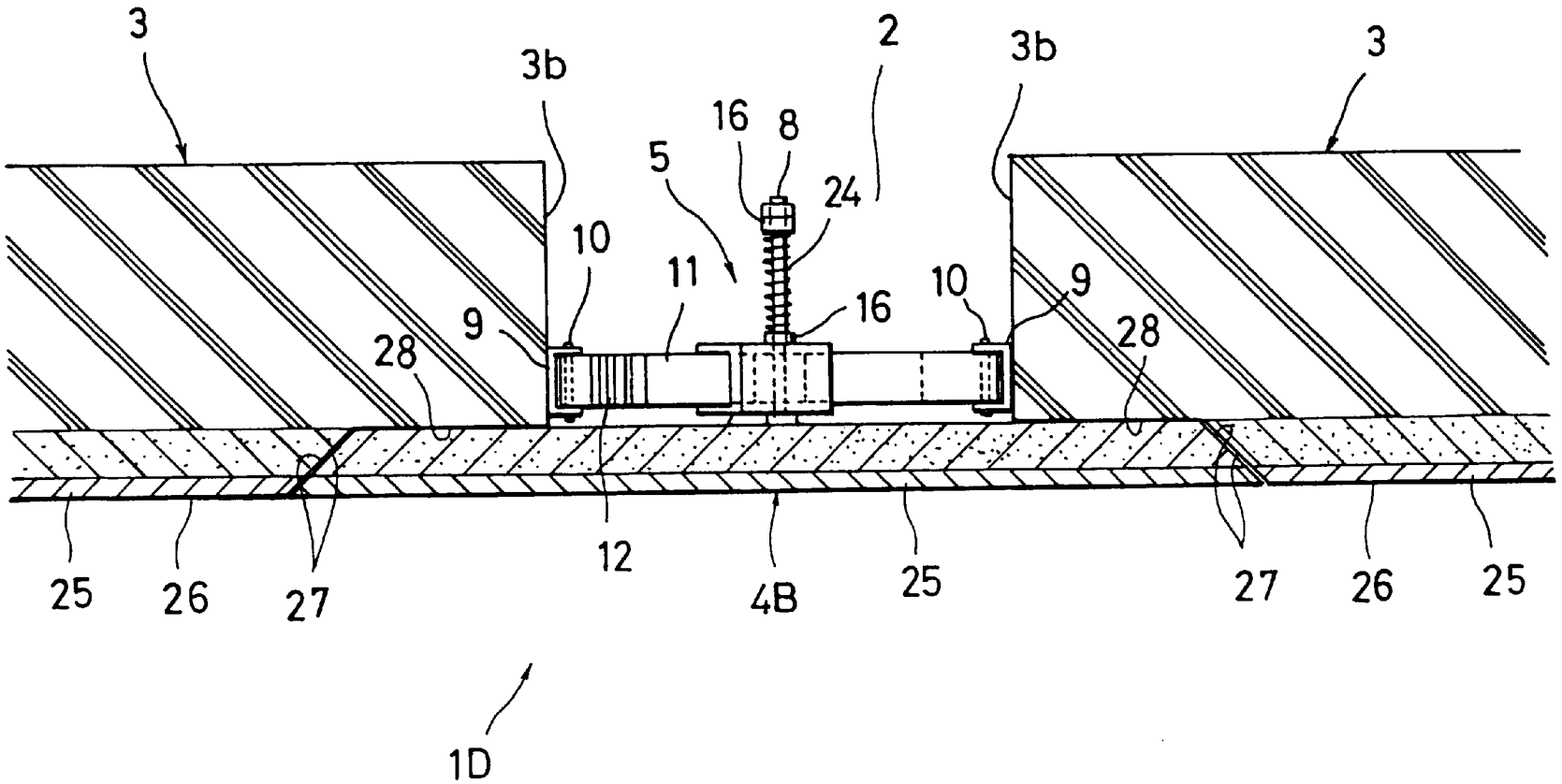
FIG. 20 is an expanded cross-sectional view taken alomg the line 20—20 of FIG. 19.
Figure 21:
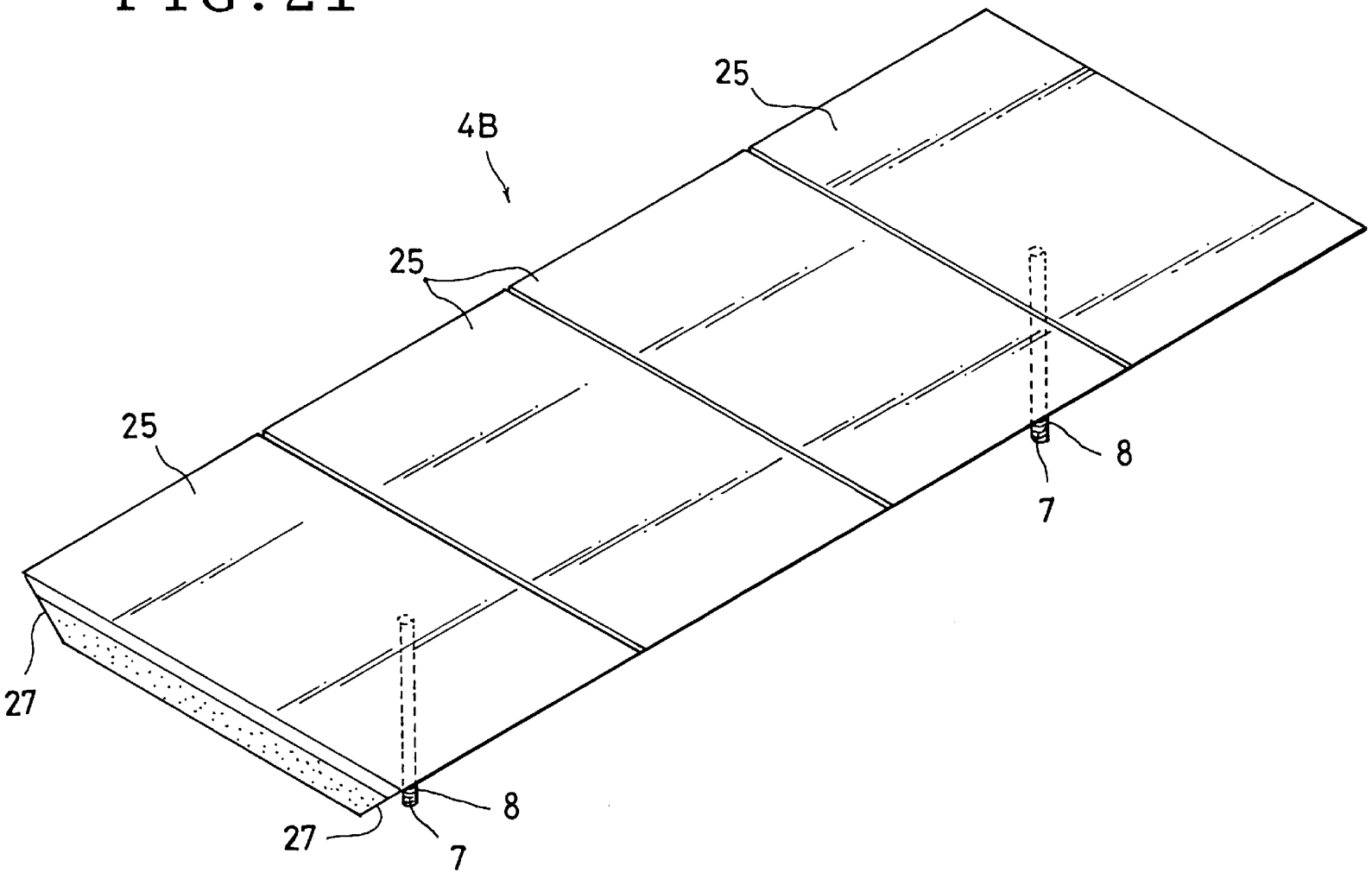
FIG. 21 is a perspective view of a joint cover.

FIGS. 19 to 21 illustrate a fifth embodiment of the present invention which is distinguished from the fourth embodiment by the fact that recessed portions 28,28 have sloping surfaces 27,27 formed at end portions, adjacent to the joint part 2 of the wall surfaces 26,26. Stone or a smoothly planed panel 25 is on the wall and the joint cover 4B is covered by stone or a smoothly planed panel 25. End portions thereof are formed in the shape of the sloping surfaces 27, 27. The end portions are capable of sliding in the recessed portions 28,28 over each other. A joint cover device 1D according to the fifth embodiment has similar advantages to that according to the fourth embodiment.

Figure 22:
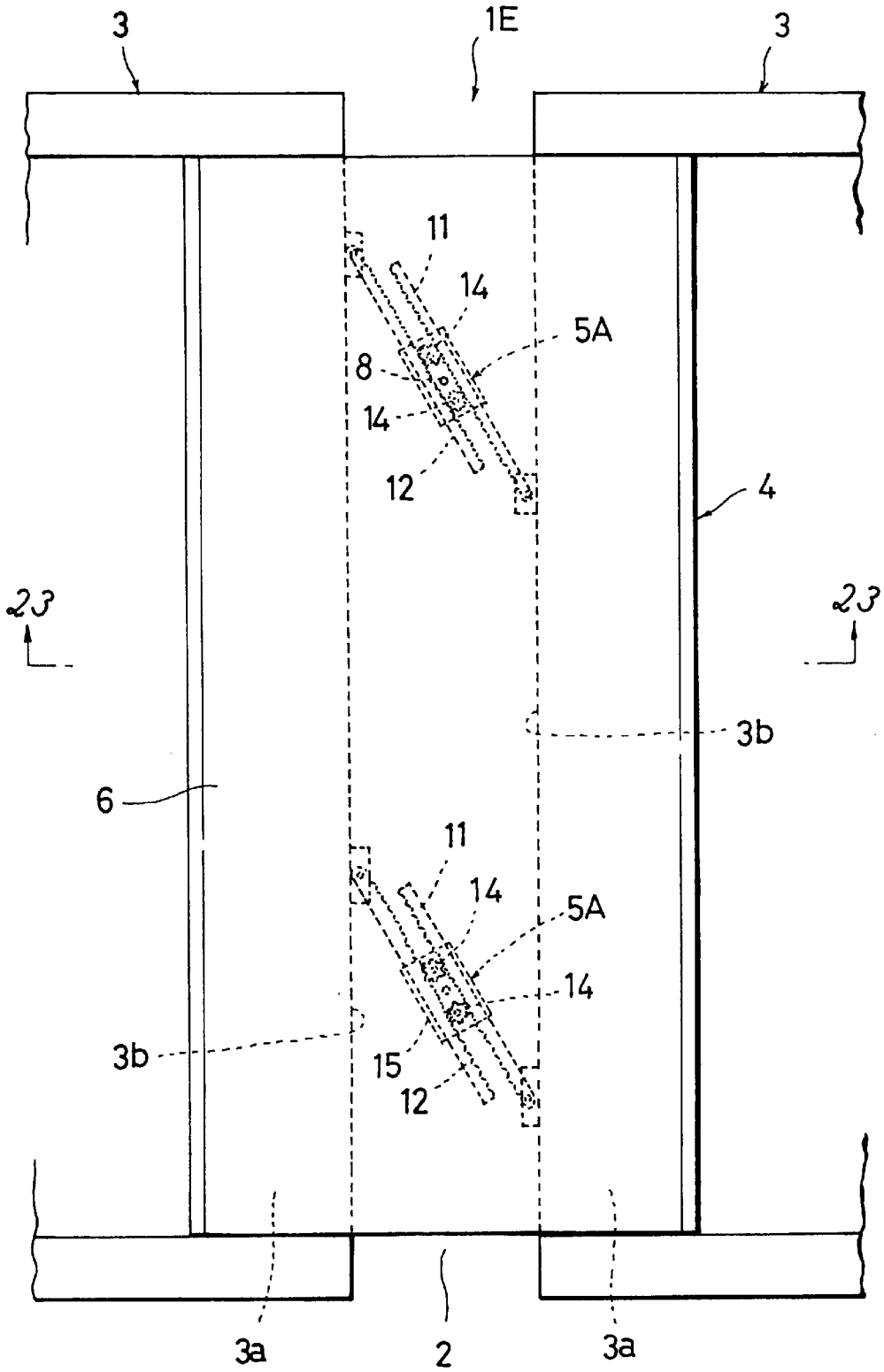
FIG. 22 is a plan view showing a sixth embodiment of the present invention.
Figure 23:
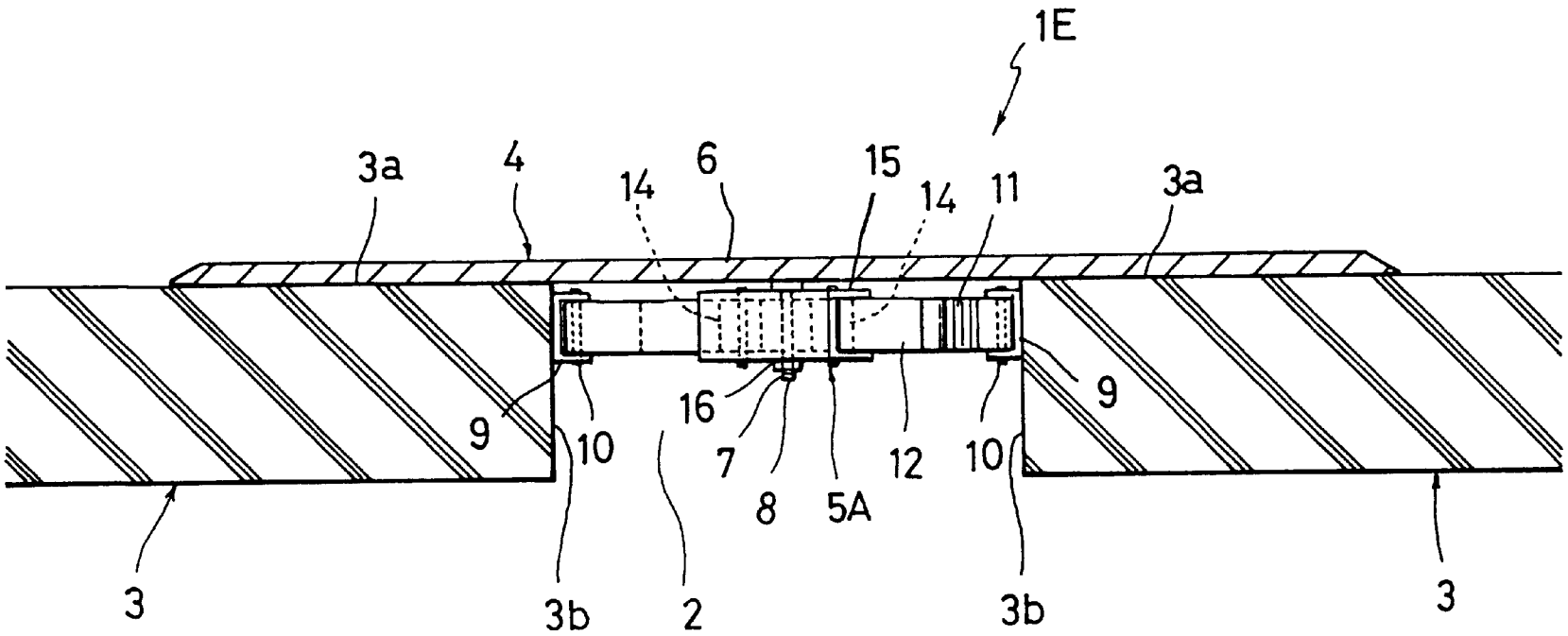
FIG. 23 is an expanded cross-sectional view taken along the line 23—23 of FIG. 22.
Figure 24:
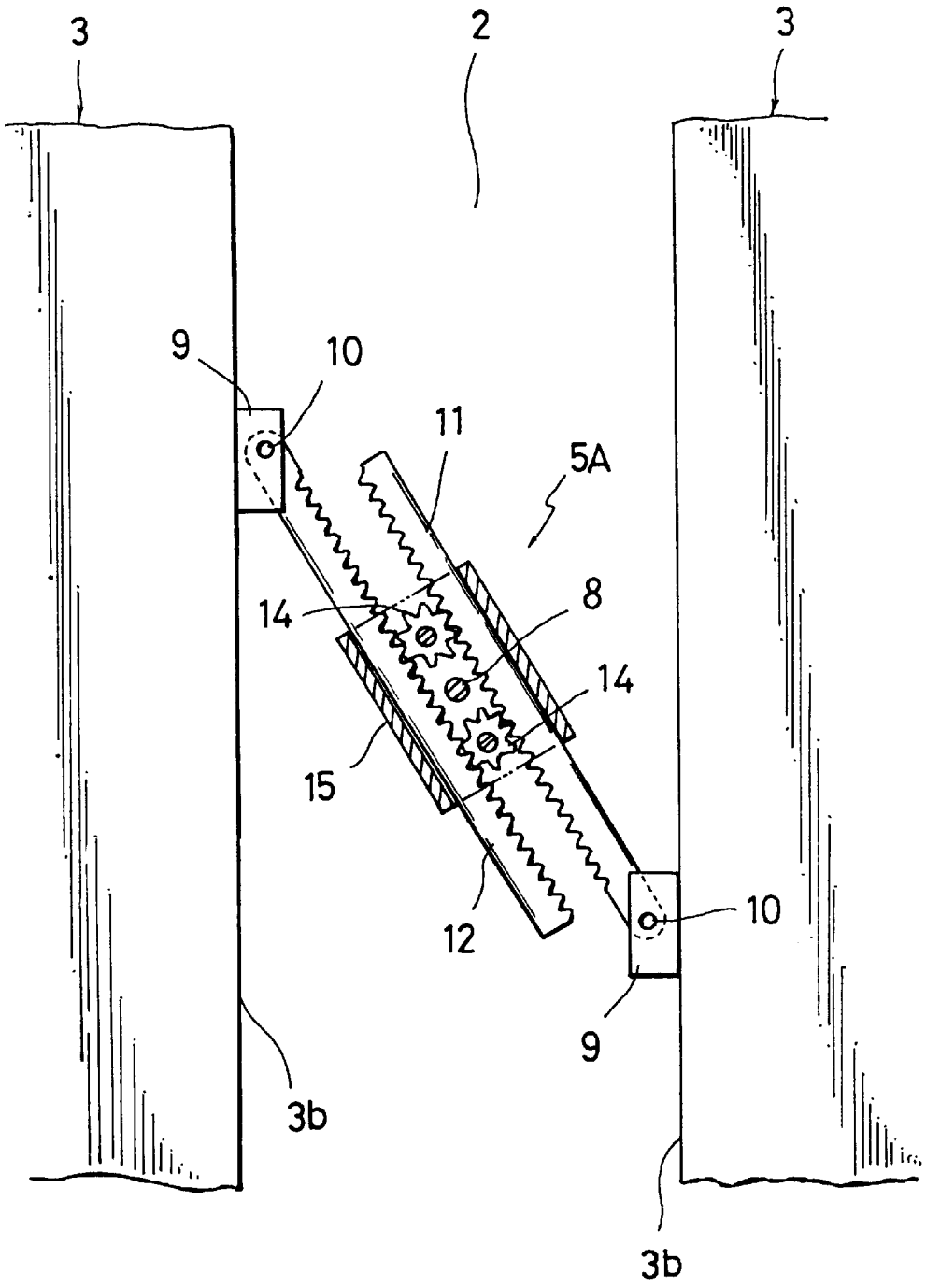
FIG. 24 is a plan view of a device for retaining joint cover at a central position.

FIGS. 22 to 24 illustrate a sixth embodiment of the present invention which is distinguished from the first embodiment by the fact that the devices for retaining the joint cover at a central position 5,5 are replaced with like devices 5A and 5A. The devices 5A, 5A include two pinions 14,14 engaging the first rack 11 and the second rack 12 which are pivotably attached to portions adjacent to both ends of the support member 15. A joint cover device 1E with the devices 5A,5A according to the sixth embodiment has similar advantages to that according to the fourth embodiment.

Figure 25:
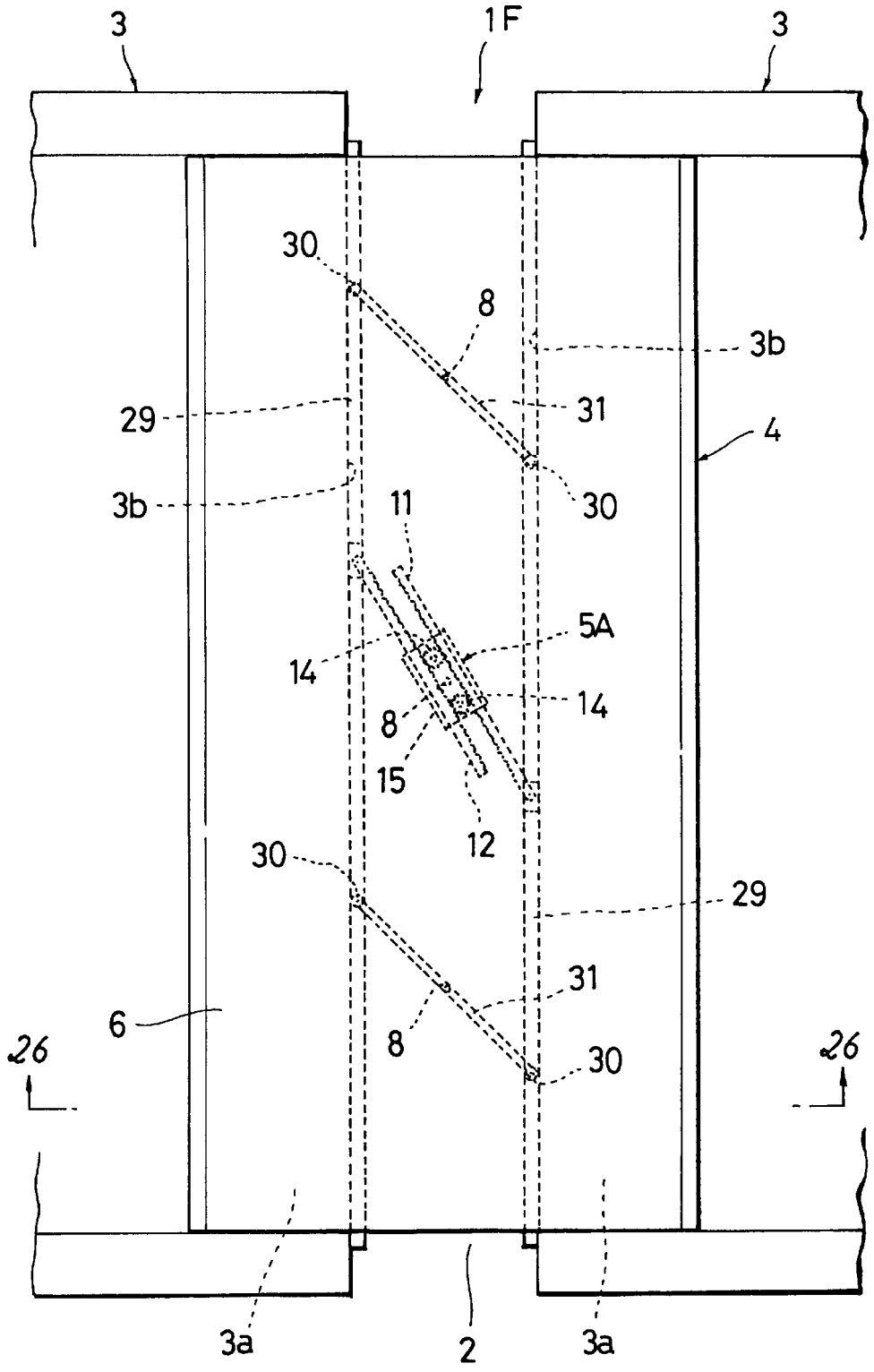
FIG. 25 is a plan view showing a seventh embodiment of the present invention.
Figure 26:
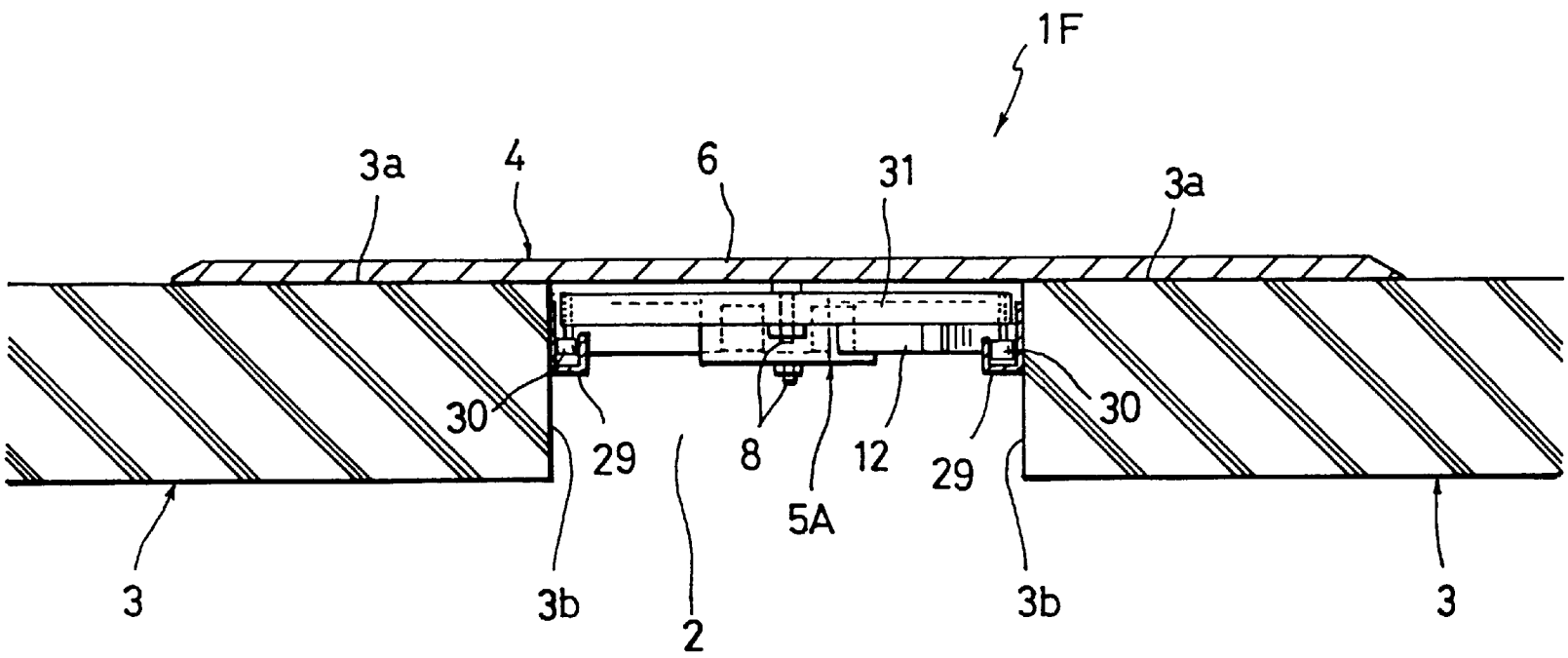
FIG. 26 is an expanded cross-sectional view taken along the line 26—26 of FIG. 25.
Figure 27:
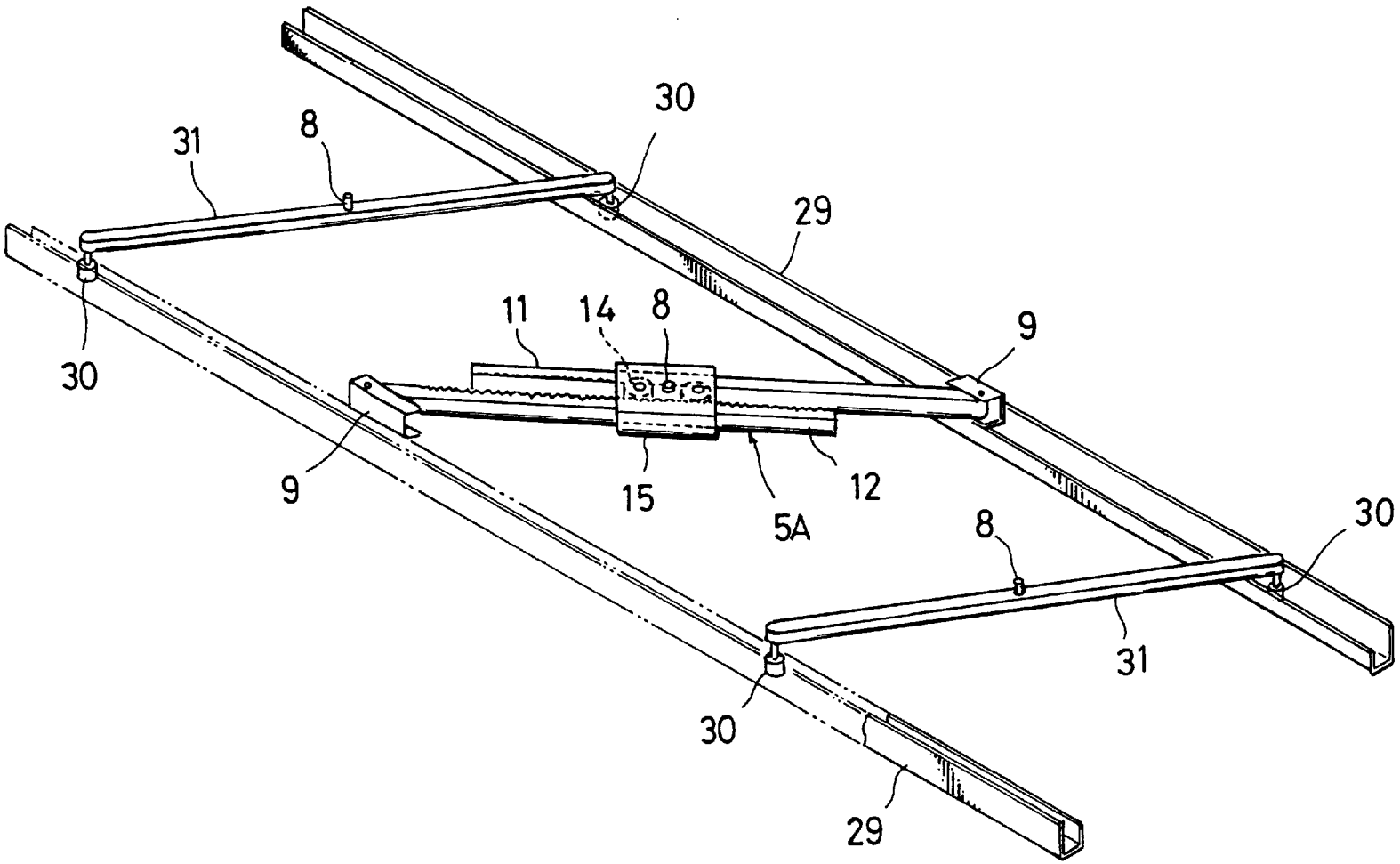
FIG. 27 is a perspective view of a device for retaining joint cover at a central position.
Figure 28:
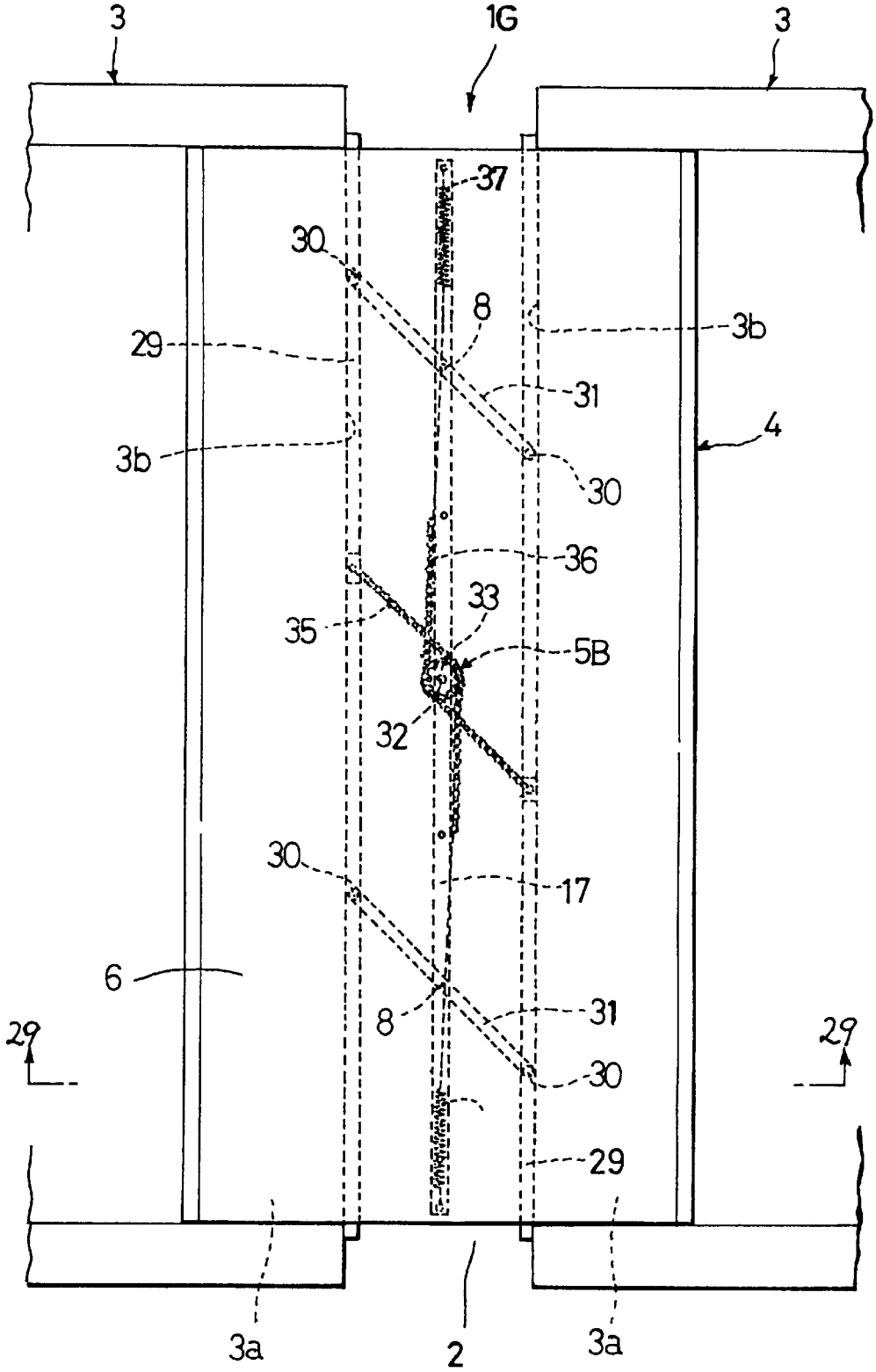
FIG. 28 is a plan view showing an eighth embodiment of the present invention.
Figure 29:
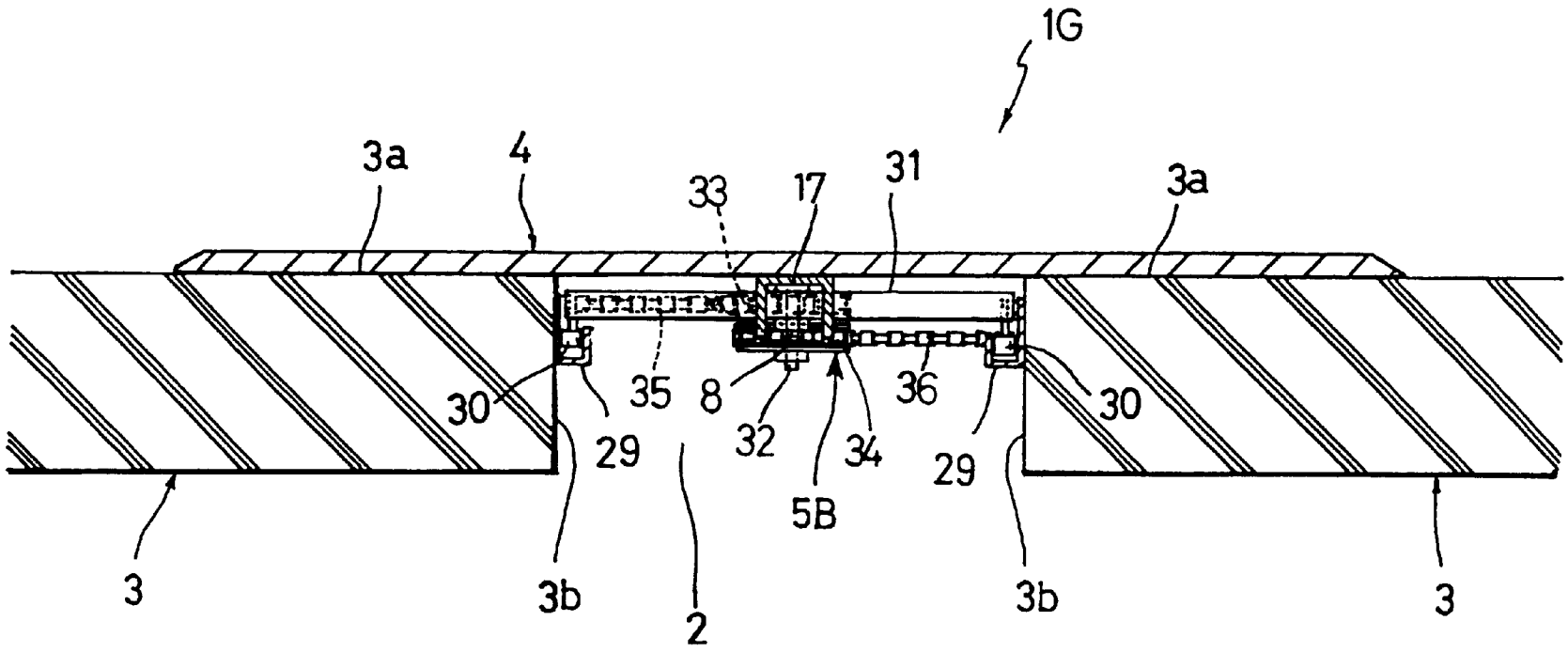
FIG. 29 is an expanded cross-sectional view taken along the line 29—29 of FIG. 28.
Figure 30:
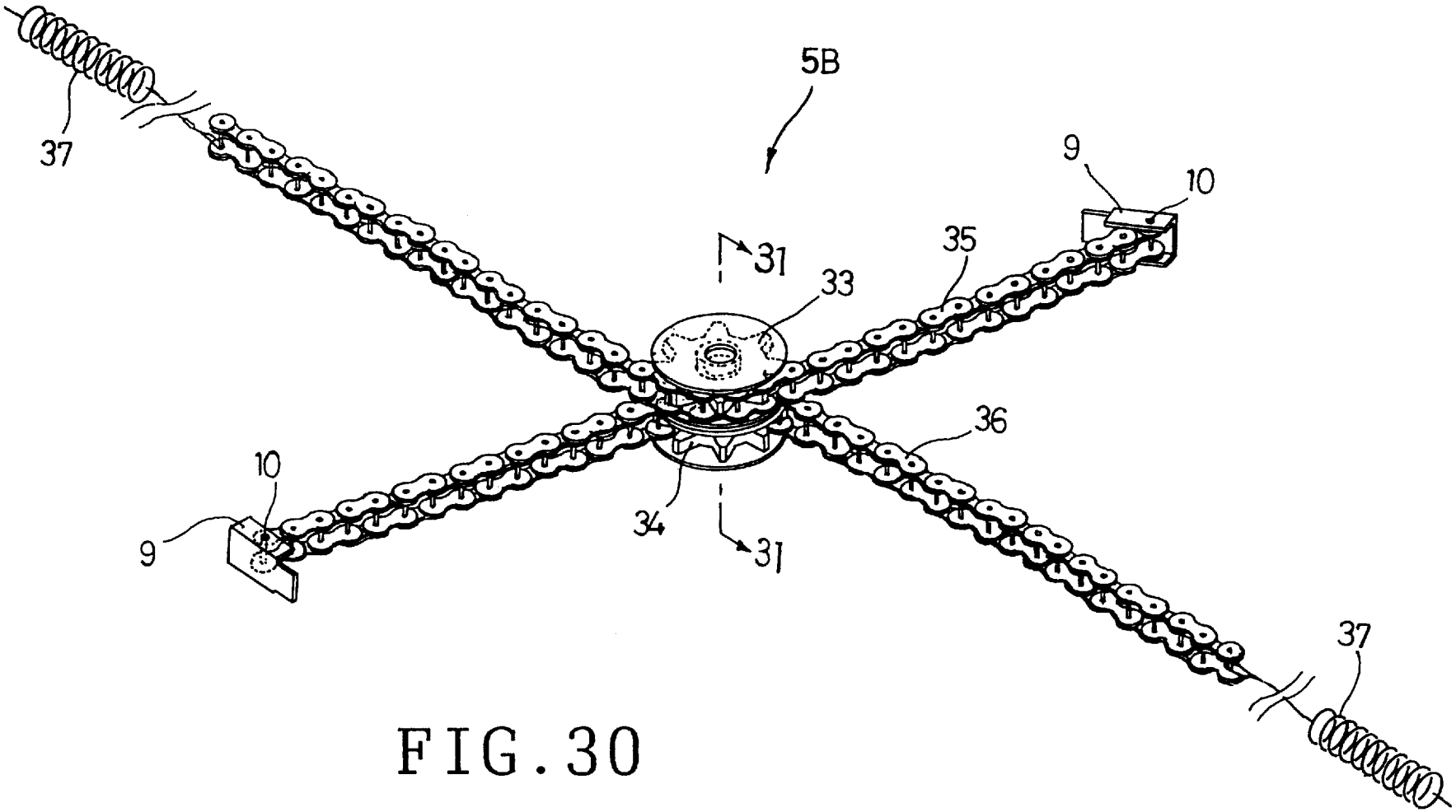
FIG. 30 is a perspective view of a device for retaining joint cover at a central position.
Figure 31:
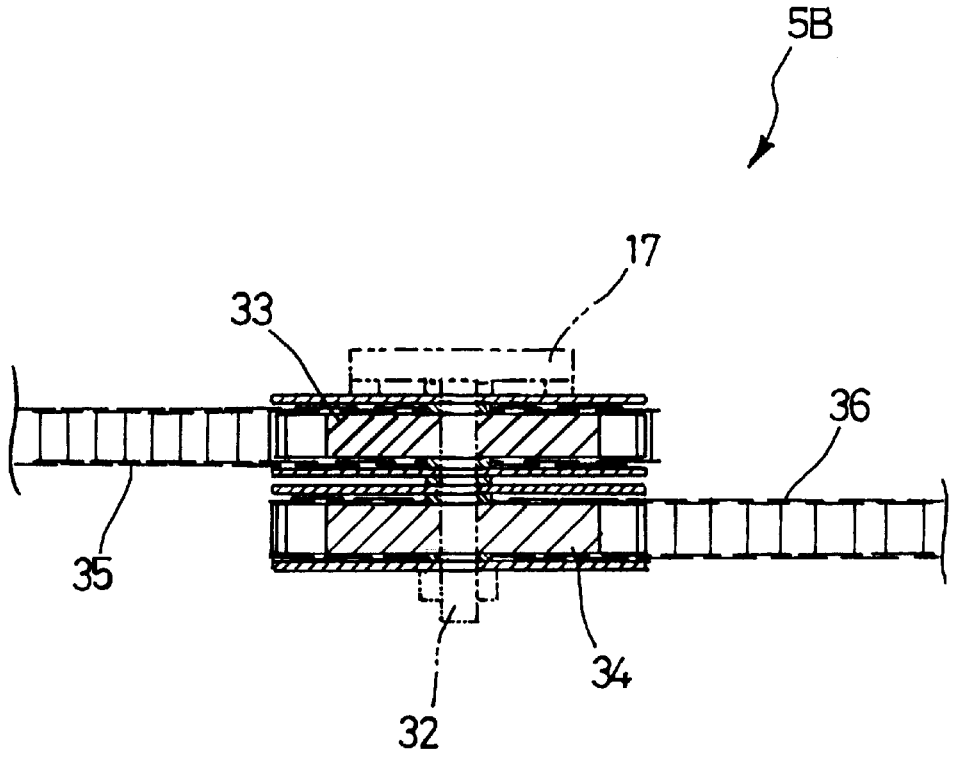
FIG. 31 is an expanded cross-sectional view taken along the line 31—31 of FIG. 30.

FIGS. 25 to 27 illustrate a seventh embodiment of the present invention which is distinguished from the sixth embodiment by the fact that a pair of guide rails 29,29 is fixed to the building portions 3*b*, 3*b*, of the joint, rollers 30,30,30,30 at ends of support rods 31, 31 slide in the pair of guide rails 29,29. The support rods 31,31 pivotally mount to the joint cover 4 by pivot pins 8,8 at central portion thereof. A joint cover device 1F according to the seventh embodiment has similar advantages to that according to the sixth embodiment.

FIGS. 28 to 31 illustrate an eighth embodiment of the present invention which is distinguished from the seventh embodiment by the fact that sprockets 33,34 are attached rotatably to an axle 32 mounted at a mounted at a substantially central part of a lower surface of a the joint cover support rod 17, and roller chains 35,36 replace the racks 11,12 described in the seventh embodiment and engage the two sprokets 33,34. The roller chains 35,36 are connected to both ends of the joint cover support rod 17 through springs 37,37. A joint cover device 1G according to the eighth embodiment has similar advantages to that according to the seventh embodiment.

Figure 32:
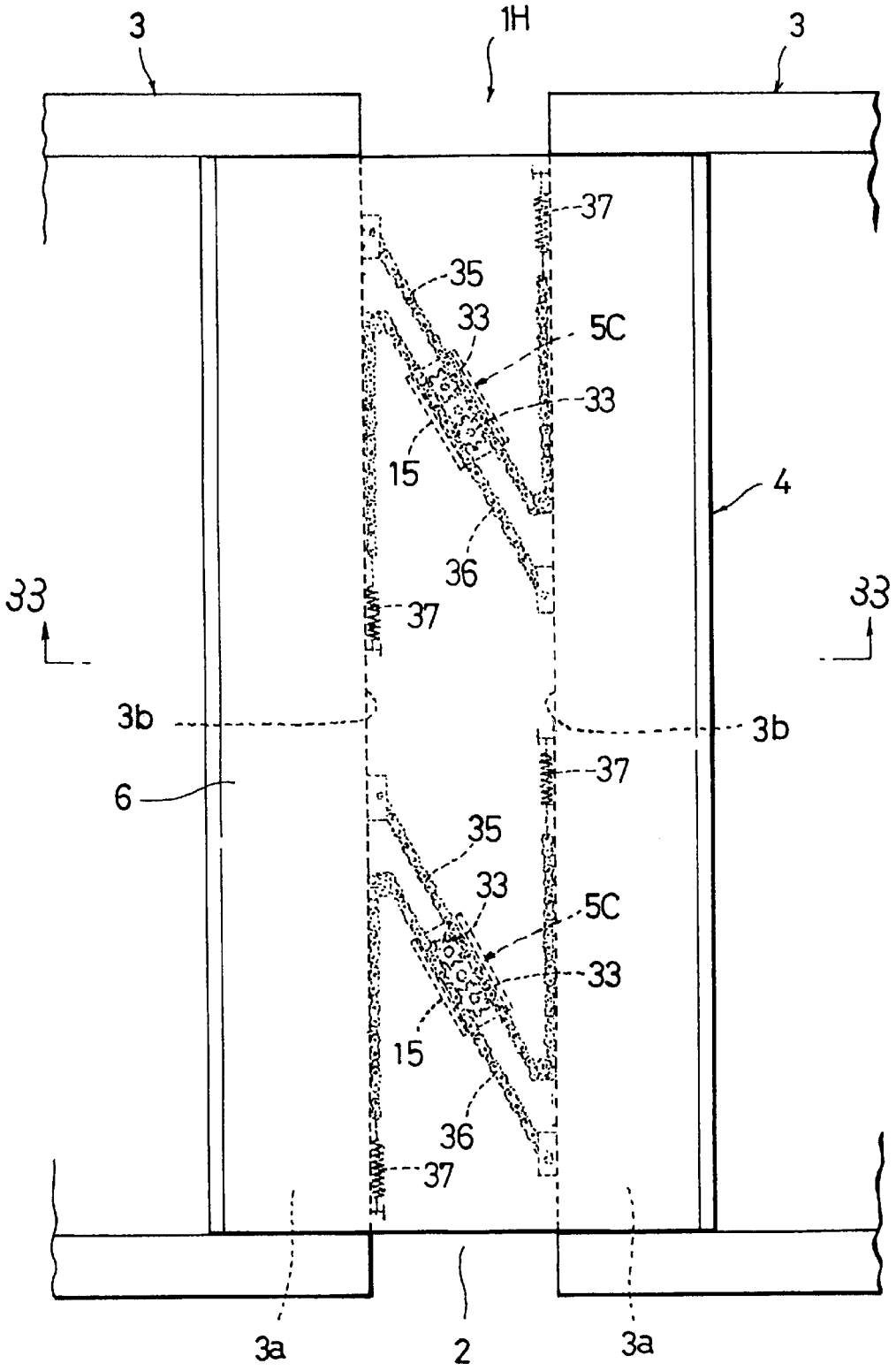
FIG. 32 is a plan view showing a ninth embodiment of the present invention.
Figure 33:
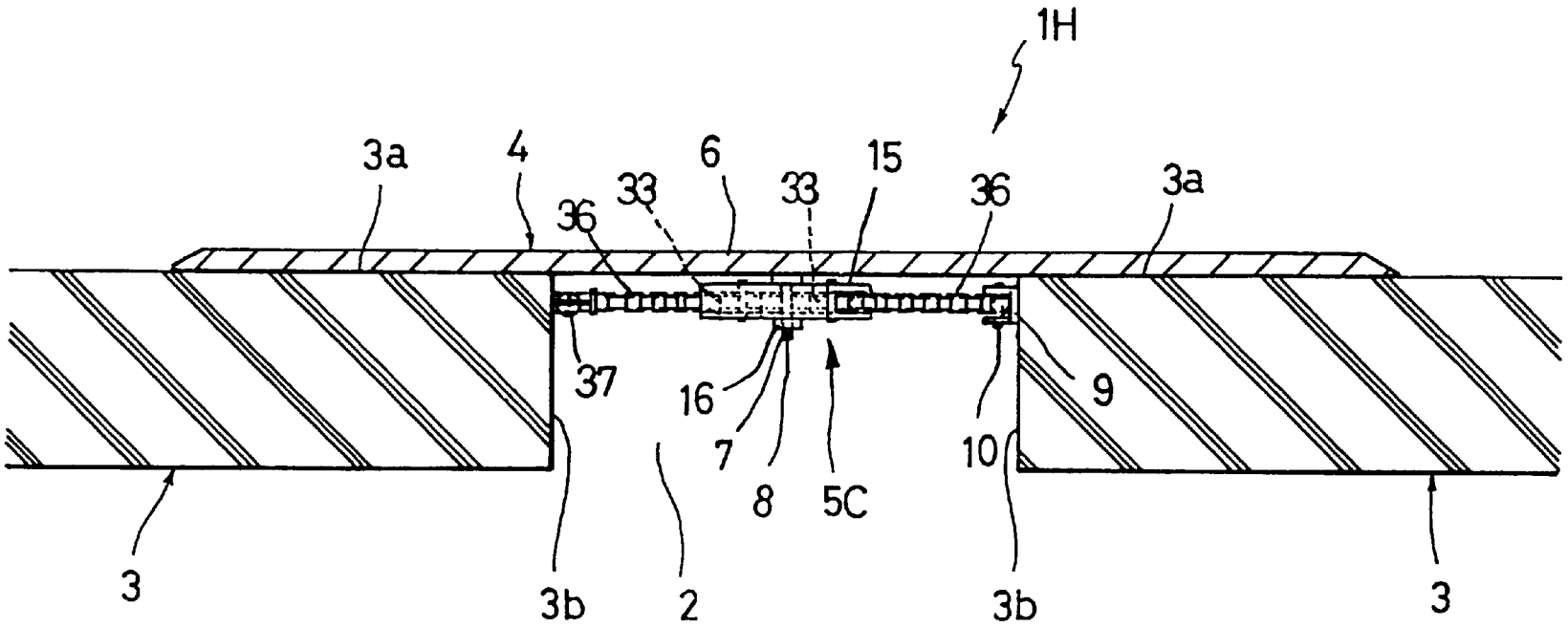
FIG. 33 is an expanded cross-sectional view taken along the line 33—33 of FIG. 32.
Figure 34:
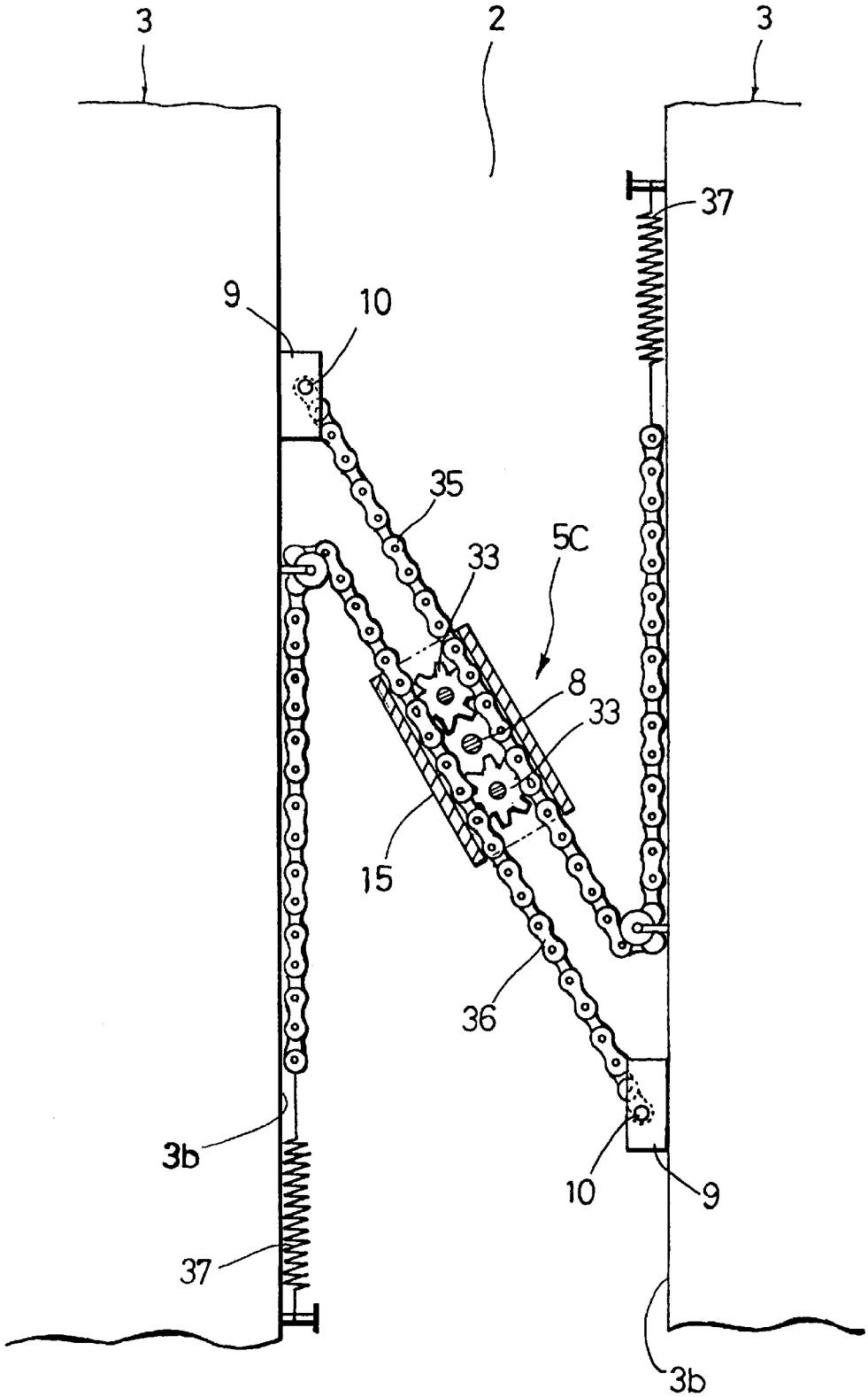
FIG. 34 is a plan view of a device for retaining joint cover at a central position.

FIGS. 32 to 34 illustrate a ninth embodiment of the present invention which is distinguished from the sixth embodiment by the fact that first and second roller chains 35,36 are biased by springs 37,37, instead of racks, and sprokets 33,33 are provided to the support member 15 and engage the first and second roller chains 35,36. A joint cover device 1H with the devices 5C,5C according to the ninth embodiment has similar advantages to that according to the sixth embodiment.

As set forth above, the advantages of the present invention are as follows:

(1) A joint cover device comprises a joint cover which covers a joint part of right and left building members. The joint cover has ends supported on surfaces adjacent the joint part. A device is provided for retaining the joint cover in a central position concealing and covering the joint part. The device has both ends attached to an associated structural section of the right and left building members. The retaining devices further include a first bar member that engages a gear, the first bar member including one end rotatably attached to a body of the joint part side portion of one of the building members in a horizontal direction. A second bar member engages the gear, the second bar member has one end rotatably attached to other the joint part side portion of the other building member in a horizontal direction. The first bar member faces the second bar member in an incline. The gear engages the first bar member and the second bar member. A support member is pivotably attached to a pivot pin which is provided substantially at a central portion of the joint cover and supports rotatably the gear and slidably supports the first and second bar members so that the joint cover device can absorb vibration and swing movement because of rotation of the bar member in a horizontal direction and geared engagement of the bar members when the right and left buildings are oscillated in back-and-forth or left-right directions, or circular movement due to an earthquake, or the like.

Therefore, the joint part between two building member having earthquake-resistant construction is covered certainly by the joint cover without subjecting to damage.

(2) As discussed above, the device for retaining the joint cover at a central portion comprises a gear, a first bar member gears engages two gears, and a support member supports slidably the bar member engaging the gears so that the structure of the device is simple, it can be established easily, (3) As discussed above, the joint cover is always located at a central portion of the joint portion by the device for retaining the joint cover at a central portion so that the joint cover does not move unequally in a right-left direction, both ends of the joint cover are supported at a surface adjacent the joint part, and it can be used safely.

What is claimed is:

1. A joint cover device for covering a joint having a joint gap defined between first and second building members, the joint gap having adjacent first and second building surfaces respectively of said first and second building members, the joint cover device comprising:

a joint cover disposed covering the joint gap and having side portions overlapping said first and second building surfaces;

a retaining device for retaining said joint cover at a central position concealing and covering said joint part, said retaining device having first and second connecting ends respectively attached to said first and second building members;

said retaining device including a first connecting device having a gear engaging portion and including said first connecting end rotatably attached to said first building member;

said retaining device including a second connecting device having a gear engaging portion and including said second connecting end rotatably attached to said second building member, said first connecting device facing said second connecting device and each inclined with respect to said first and second building members;

a gear engaging said gear engaging portions of said first con;necting device and said second connecting device and a support member pivotably attached by a pivot pin to a substantially central portion of said joint cover, and said support member rotatably supporting said gear and slidably supporting said first connecting device and said second connecting device with said gear engaging portions engaging said gear.

2. The joint cover device according to claim 1, wherein said first and second connecting devices are first and second bar members and said gear engaging portions are racks and said pivot pin is inserted into said gear to rotatably support said gear and said support member.

3. The joint cover device according to claim 1, further comprising:

a second gear engaging said gear engaging portions of said first and second connecting devices;

said retaining device being pivotably mounted to the substantially central portion of said joint by said pivot pin supporting a central portion of said support member; and said retaining device including said gear and said second gear being respectively rotatably supported at first and second end portions of said support member on opposing sides of said central portion of said support member.

4. The joint cover device according to claim 1, wherein:

said first connecting device is a first roller chain including said first connecting end connected to said first building member and a first biased end attached to said second building member by an elastic biasing device;

said second connecting device is a second roller chain including said second connecting end connected to said second building member and a second biased end connected to said first building member; and said gear is a sprocket engaging said first and second roller chains.

5. A joint cover device for covering a joint having a joint gap defined between first and second building members, the joint gap having adjacent first and second building surfaces respectively of said first and second building members, comprising:

a joint cover disposed covering the joint gap and having side portions overlapping said first and second building surfaces;

a retaining device for retaining said joint cover at a central position concealing and covering said joint part, said retaining device having first and second connecting ends respectively attached to said first and second building members;

said retaining device including first and second guide rails respectively disposed on said first and second building members;

a pair of support rods each having end portions slidably disposed in opposing ones of said first and second guide rails;

a joint cover support rod supporting a central portion of said joint cover at a substantially central portion of each of said pair of support rods by a pivot pin;

first and second sprockets rotatable mounted and rotatable disposed on said joint cover support rod;

a first roller chain including said first connecting end of said retaining device connected to said first building member and another first roller chain end coupled to said second building member;

a first biasing spring coupling said another first roller chain end to said second building member;

a second roller chain including said second connecting end of said retaining device connected to said second building member and another second roller chain end coupled to said first building member;

a second biasing spring coupling said another second roller chain end to said first building member; and said first and second sprockets respectively engaging said first and second roller chains such that said first and second roller chains extend therefrom equidistantly in opposite directions.

6. The joint cover device of claim 5 wherein:

said first roller chain has a first chain portion extending along said second building member, said first chain portion extending between said another first roller chain end and a first redirecting device installed on said second building member; and said second roller chain has a second chain portion extending along said first building member, said second chain portion extending between said another second roller chain end and a second redirecting device installed on said second building member.

7. The joint cover device of claim 6 wherein said first and second redirecting devices are sprockets rotatably mounted on said second building member and said first building member.

8. A joint cover device for covering a joint having a joint gap defined between first and second building members, the joint gap having adjacent first and second building surfaces respectively of said first and second building members, the joint cover device comprising:

a joint cover disposed covering the joint gap and having side portions overlapping said first and second building surfaces;

a retaining device for retaining said joint cover at a central position concealing and covering said joint part, said retaining device having first and second connecting ends respectively attached to said first and second building members;

a sprocket unit rotatably mounted at an underside of said joint cover;

a first roller chain including said first connecting end of said retaining device connected to said first building member and another first roller chain end coupled to said second building member;

a first biasing spring coupling said another first roller chain end to said second building member;

a second roller chain including said second connecting end of said retaining device connected to said second building member and another second roller chain end coupled to said first building member;

a second biasing spring coupling said another second roller chain end to said first building member; and said sprocket unit engaging said first and second roller chains such that said first and second roller chains extend therefrom equidistantly in opposite directions.

9. The joint cover device of claim 8 further comprising:

first and second guide rails respectively disposed on said first and second building members;

a pair of support rods each having end portions slidably disposed in opposing ones of said first and second guide rails; and said pair of support rods being coupled to said underside of said joint cover.

10. The joint cover device of claim 9 further comprising:

a joint cover support rod supporting a central portion of said joint cover at a substantially central portion of each of said pair of support rods by a pivot pin; and said join cover support rod rotatably coupling said sprocket device to said joint cover.

11. The joint cover device of claim 8 wherein said sprocket device includes first and second sprockets rotatably mounted and rotatably disposed on said underside of said joint cover.

* * * * *